US012638275B2

(12) United States Patent
Brunelle

(10) Patent No.: US 12,638,275 B2
(45) Date of Patent: May 26, 2026

(54) PORTABLE DYNAMIC AUTOMATIC REACTIVE TARGET SYSTEM FOR ENHANCED FIREARMS TRAINING

(71) Applicant: Theodore Melyan Brunelle, New Milford, PA (US)

(72) Inventor: Theodore Melyan Brunelle, New Milford, PA (US)

( * ) Notice: Subject to any disclaimer, the term of this patent is extended or adjusted under 35 U.S.C. 154(b) by 0 days.

(21) Appl. No.: 18/786,429

(22) Filed: Jul. 26, 2024

(65) Prior Publication Data

US 2026/0029219 A1 Jan. 29, 2026

(51) Int. Cl.
*F41J 7/04* (2006.01)
*F41J 5/14* (2006.01)

(52) U.S. Cl.
CPC .. *F41J 7/04* (2013.01); *F41J 5/14* (2013.01)

(58) Field of Classification Search
CPC ..... F41J 7/04; F41J 5/14
See application file for complete search history.

(56) References Cited

U.S. PATENT DOCUMENTS 4,330,129 A * 5/1982 Meredith ..... F41J 1/10 273/372
4,807,888 A * 2/1989 Pidde ..... F41J 7/04 273/392
5,346,226 A * 9/1994 Block ..... F41J 7/04 273/392
5,603,505 A * 2/1997 Acock ..... F41J 7/06 273/391
8,777,226 B1 * 7/2014 Decker, Jr. ..... F41J 7/06 463/2
10,295,315 B2 * 5/2019 Harris ..... F41J 1/10
12,345,511 B1 * 7/2025 Kraft ..... F41J 5/14
2005/0153262 A1 * 7/2005 Kendir ..... F41G 3/2655 434/21
2007/0235943 A1 * 10/2007 Bateman ..... F41J 1/10 273/408
2008/0174071 A1 * 7/2008 Potterfield ..... F41J 9/02 273/366
2010/0276888 A1 * 11/2010 Wright ..... F41J 7/06 273/406
2012/0205870 A1 * 8/2012 Saunders ..... F41J 7/04 273/392
2015/0130136 A1 * 5/2015 Bliehall ..... F41J 5/20 273/390
2016/0076859 A1 * 3/2016 Chester ..... F41J 5/056 273/386
2016/0305749 A9 * 10/2016 Mason ..... F41J 5/02
2017/0059288 A1 * 3/2017 Campbell ..... F41J 7/04
(Continued)

*Primary Examiner* — Malina D. Blaise

(57) ABSTRACT

A portable, dynamic, and wireless reactive target system designed for firearms training. The system features electromechanical targets that dynamically present themselves and record performance metrics, enhancing shooter training through varied target presentations. The targets communicate wirelessly with a central controller application on a tablet, offering flexible deployment and rapid setup. Performance data is analyzed and displayed in customizable reports, enabling targeted skill improvement. The system includes features like LED illumination for specialized drills and competitive scenarios, ensuring a comprehensive and realistic training experience.

5 Claims, 26 Drawing Sheets

(56) References Cited

U.S. PATENT DOCUMENTS

| | | | | |
|---|---|---|---|---|
| 2017/0328687 | A1* | 11/2017 | Hill | F41J 1/10 |
| 2018/0202776 | A1* | 7/2018 | Huang | F41J 5/00 |
| 2019/0249963 | A1* | 8/2019 | Pendleton | F41J 5/18 |
| 2021/0102782 | A1* | 4/2021 | Tamir | F41G 3/2627 |
| 2021/0215465 | A1* | 7/2021 | Guedon | F41J 7/04 |
| 2023/0235996 | A1* | 7/2023 | Rempel | F41J 7/04<br>273/369 |
| 2024/0027173 | A1* | 1/2024 | Leaning | F41J 7/06 |
| 2024/0191977 | A1* | 6/2024 | Bell, III | F41J 7/04 |

* cited by examiner

PORTABLE DYNAMIC AUTOMATIC REACTIVE TARGET SYSTEM FOR ENHANCED FIREARMS TRAINING

CROSS-REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

The present invention relates to firearm training systems and equipment, specifically to a dynamic training system for gun ranges that provides shooters with dynamically presented targets, and records their performance metrics for analysis and display in customized data driven training program reports.

BACKGROUND OF THE INVENTION

Conventional gun ranges are limited in their training capabilities due to largely stationary targets and static setups that are built in place at a range, and cannot be easily re-configured without great expense and major construction efforts.

Typically, ranges offer static targets—paper or steel targets—set at a fixed distance from the shooter, with the objective of shooting them as close to drawn markings on the targets as possible (often a bull's eye). Since the shooter fixates their weapon's position and aiming sights on the center of the target, and repeatedly pulls the trigger, without the need to reacquire the target's position, this limits training effectiveness. Shooters usually only require slight readjustments to their weapon's position, before pulling the trigger again. The shooter then effectively repeats the same training drill over and over, without varying the diversity of their training. Outside of a training range however, targets that a shooter would be shooting at most likely are not just standing still—they are appearing often with an element of surprise, moving, and changing position.

There have been several attempts to implement more dynamic target training systems, ranging from simple machines that are physically moved by the target changing its balancing point each time it is hit, to highly complicated pneumatic driven training systems. Simple machines include setups that have pendulums that "flip" when shot by a user, to a pinwheel on a central pivot arrangement of steel plates designed to "fall off" of the pinwheel, causing it to re-center it's balance point, and rotate ("Texas Stars"). Both of these are very limited in their training and skill set optimization of the shooter. More elaborate systems utilizing motors and pneumatics include systems like the "Roger's Range," where steel plates on pneumatic cylinders positioning usually about ⅓, ⅔, and fully down range, positioned left, right, and center range respectively. These targets are designed to swing out, and sense a hit of a bullet from the shooter. While this is slightly more dynamic in nature, and captures the element of surprise, the systems require long, expensive fixtures and pneumatic lines, often buried in concrete setups that cost a significant amount of money. Furthermore, moving or transporting such a range would involve demolishing the old range, and rebuilding the system. Reconfiguring the system, other than simple timing of when the plates swing out, would require again, rebuilding the range.

Metrics gathered by current systems are largely done manually, counting the number of "hits" on paper targets. There is a lack of real-time, accurate, data on the shooter's performance beyond this.

There is a need for a portable, dynamic system that enhances training by providing varied target presentations, gathering details of shooter's performance, and enhancing training by providing varied target presentation.

BRIEF SUMMARY OF THE INVENTION

The present invention provides a novel dynamic gun range training system for enhancing shooter training through dynamically presented targets. The system comprises one or more targets positioned on a shooting range stage, each linked via wireless communication to a central controller application. The controller application manages the raising and lowering of target plates according to a defined schedule, referred to as a "drill."

The system offers various target arrangement options, spanning from a single (one position) unit, to simultaneous multiple targets that work together. It is designed for portability, enabling rapid setup and disassembly. The wireless communication between the targets and the central controller application allows for flexible deployment at varying distances and arrangements.

The targets expose, or "present" themselves, for a finite duration of time, allowing a limited window for the shooter to engage and hit the targets. When a target is hit, the system records the hit time, which is sent to the controller app. The controller app then computes various performance metrics or scores. These metrics are displayable on the user's app, and depending on the application, either posted to a leader board, sent in the form of a report, and/or are viewable by the user in a number of report presentations.

The system includes a colored LED (light) system that directs target plate illumination based on the drill. This light system allows for the target plate to be "painted" various colors, dynamically This feature enables specialized drills to be created, such as go/no-go engagements and competitive teaming. For example, the user can be instructed to only shoot red targets. Therefore, when shooting a target that is red—a point gain will be realized, when blue—a point loss will occur, and when yellow—the target is about to turn either red or blue however the target color is concealed until the last moment, before the target retracts.

A dynamic scoring option incorporated into the system allows for scoring drill scenarios. For example, a decaying score value system can be utilized, where a user's score for hitting a target decreases over the time from it's presentation, to the time of the target plates retraction. Another example would be target discrimination training scenarios where illuminated target colors can count as negatively and positively scored hits, and varying time presentation of different targets.

Each target plate is made from durable material capable of withstanding repeated impacts from projectiles such as bullets. The targets are raised and lowered by a linear actuator. The target plate is mounted on a pivot or hinge, allowing it to fall backward when hit. This allows for a unique mechanism that always ensures the target is raised vertically, and falls back horizontally, avoiding the "Dracula rising from a coffin" type motion. When the target is hit, a sensor (optical interrupt, Hall effect sensor, or similar)

registers the hit, and the target is retracted and reset downward via the linear actuator and target recovery system, reset for the next drill.

The system improves shooter training by providing dynamic and varied target presentations, recording performance metrics, and allowing specialized training scenarios, all within a portable and easily deployable design.

SCHEDULE OF DRAWINGS:

| FIG. # | Description |
|---|---|
| 1 | Target (Isometric view) - target plate in up position |
| 2 | Exploded diagram of major assemblies |
| 3 | Frame assembly |
| 4 | Target transit assembly |
| 5 | Transit in track assembly |
| 6 | Linear springs |
| 7 | Elevator assembly |
| 8 | Electronics assembly |
| 9A | Optical interrupts - target not hit |
| 9B | Optical interrupts - target hit |
| 10 | Recovery assembly |
| 11 | Shield assembly |
| 12 | Chassis mounting to Shields |
| 13A | Stand Assembly |

-continued

SCHEDULE OF DRAWINGS:

| FIG. # | Description |
|---|---|
| 13B | Stand mounting plate |
| 13C | Stand and shield base plate |
| 13D | Stand and shield mating in-process |
| 13E | Stand and shield mating completed |
| 14 | LED Illuminator operation |
| 15[A-F] | Transit states |
| 16 | Embedded Circuit Block Diagram |
| 17 | System hierarchy flowchart |
| 18 | Overview of stage of 3 targets |
| 19 | POV view of stage of 3 targets |
| 20 | Target Event scheduler |
| 21 | App flowchart of program flow |
| 22A | Drill app - drill selector |
| 22B | Drill app - drill briefing |
| 22C | Drill app - run drill |
| 22D | Drill app - scores |
| 22E | Drill app - leaderboard |
| 22F | Drill Composer |
| 22G | Drill app - stage setup |
| 22H | Drill app - system provisioning |

SCHEDULE OF PARTS IN DRAWINGS:

| Part # | Assembly | FIGS. | Name |
|---|---|---|---|
| 1 | yes | 1 | Target Unit Assembly |
| 2 | no | 1, 4, 5, 9A, 9B, 14, 15 | Target Plate |
| 3 | yes | 1, 2, 5, 13 | Stand Assembly |
| 4 | yes | 2, 5, 6, 8, 12 | Chassis Assembly |
| 5 | yes | 2, 4, 5, 6, 9A, 9B, 10 | Transit Assembly |
| 6 | yes | 2, 7 | Elevator Assembly |
| 7 | yes | 2, 8 | Optical Interrupt Assembly Bottom |
| 8 | yes | 2, 8 | Optical Interrupt Assembly Middle |
| 9 | yes | 2, 8 | Optical Interrupt Assembly Top And Hit |
| 10 | yes | 2, 8, 9A, 9B, | Embedded Computer Box Assembly |
| 10A | no | 8 | Embedded Computer Box Cover |
| 10B | no | 8 | Embedded Computer Motherboard |
| 10C | no | 8 | Embedded Computer Box |
| 10D | no | 8 | Embedded Computer Mounting Screws |
| 11 | no | 2, 8 | Battery Holder |
| 12 | no | 2, 8 | Battery |
| 13 | yes | 2, 10 | Recovery Assembly |
| 14 | yes | 2, 11, 12 | Shield Assembly |
| 15 | no | 3 | Chassis Base |
| 16 | no | 3 | Chassis Vertical Track Left |
| 17 | no | 3 | Chassis Vertical Track Right |
| 18 | no | 3 | Chassis Vertical Track Screws |
| 19 | no | 3 | Chassis Top |
| 20 | no | 3, 12 | Frame Mount |
| 21 | no | 3, 12 | Frame Mount Peg |
| 22 | no | 3, 12 | Frame Mount Peg Bolt |
| 23 | no | 3 | Frame to Vertical Track Bolt |
| 24 | no | 4, 10 | Transit Frame |
| 25 | no | 4 | Transit Vertical Guide |
| 26 | no | 4, 10 | Transit Frame Target Plate Mount |
| 27 | no | 4 | Transit Frame Pivot Pin |
| 28 | no | 4 | Transit Recovery Spring Bushing |
| 29 | no | 4 | Transit Recovery Spring |
| 30 | no | 4 | Transit Recovery Spring Clip |
| 31A | no | 4, 9A, 9B | Optical Interrupt Transit Tab |
| 31B | no | 4, 9A, 9B | Optical Interrupt Target Tab |
| 32 | no | 4 | Transit Chain Mount Block |
| 33 | no | 4 | Transit Drive Chain |
| 34 | no | 4 | Drive Chain Screws |
| 35 | no | 7 | Elevator Assembly Mount |
| 36 | no | 7, 15[A-F] | Drive Motor |
| 37 | no | 7 | Drive Sprocket |
| 38 | no | 7 | Elevator Top Drive Support Center Bracket |
| 39 | no | 7 | Elevator Top Drive Support Left Bracket |
| 40 | no | 7 | Elevator Top Drive Support Right Bracket |
| 41 | no | 7 | Top Drive Idle Shaft |

-continued

SCHEDULE OF PARTS IN DRAWINGS:

| Part # | Assembly | FIGS. | Name |
|---|---|---|---|
| 42 | no | 7 | Top Drive Idle Sprocket |
| 43 | no | 7 | Linear-Spring Bushing |
| 44 | no | 6, 7 | Linear-Spring |
| 45 | no | 7 | Linear Spring Bushing Bearing |
| 46 | no | 7 | Front Outer Idler Sprocket |
| 47 | no | 7 | Front Outer Idler Sprocket Shaft |
| 48 | no | 7 | Elevator Assembly Outer Shaft Mounting Plate |
| 49 | no | 7 | Idler Sprocket Bearing |
| 50 | no | 7 | Idler Sprocket Shaft Spacer |
| 51 | no | 7 | Front Inner Idler Sprocket |
| 52 | no | 7 | Elevator Bracket Spacer |
| 53 | no | 7 | Tension Sprocket |
| 54 | no | 7 | Front Inner Idler Sprocket Shaft |
| 55 | no | 7 | Tension Spring Bushing |
| 56 | no | 7 | Tension Arm Bearing |
| 57 | no | 7 | Tension Arm Spacing Washer |
| 58 | no | 7 | Tension Arm Spring |
| 59 | no | 7 | Tension Spring Clip |
| 60 | no | 8, 9A, 9B | Optical Interrupt Bracket For Bottom and Middle |
| 61 | no | 8, 9A, 9B | Optical Interrupt Circuit Board |
| 62 | no | 8, 9A, 9B | Optical Interrupt Assembly Top and Hit Bracket |
| 63 | no | 8 | Optical Interrupt Debris Shield |
| 64 | no | 8, 12, 14 | Illuminator Base |
| 65 | no | 8, 14 | Illuminator Led Circuit Board |
| 66 | no | 8, 12 | Illuminator Clear Shield |
| 67 | no | 10, 15[A-F] | Recovery Foot |
| 68 | no | 10 | Recovery Bushing |
| 69 | no | 10 | Recovery Bushing Shaft Bearing |
| 70 | no | 10 | Recovery Bushing Shaft |
| 71 | no | 10 | Recovery Shaft Mount Plate Cover |
| 72 | no | 10 | Recovery Spacer |
| 73 | no | 11, 13C | Shield Base |
| 74 | no | 11 | Front Shield |
| 75 | no | 11 | Left Shield |
| 76 | no | 11 | Right Shield |
| 77 | no | 11, 12 | Receiver Mounting Bracket |
| 77A | no | 12 | Receiver Slot |
| 78 | no | 11, 12 | Shield Bolt |
| 78 | no | 11 | Shield Bolt Nut |
| 79 | no | 13[A-E] | Stand top |
| 79A | no | 13[A-E] | Stand top Hook |
| 79B | no | 13[A-E] | Stand Locking Pin |
| 79C | no | 13[A-E] | Stand Latch |
| 79D | no | 13[A-B] | Stand Hook Latches |
| 79E | no | 11 | Stand Hook Hole |
| 79F | no | 11 | Stand Locking Pin Hole |
| 79G | no | 11 | Stand Latch Hole |
| 79H | no | 11 | Stand Latch Pin |
| 79I | no | 13E | Stand Latch Pull Point |
| 79J | no | 13B | Latch bolts |
| 79K | no | 13B | Latch frame |
| 79L | no | 13D, 13E | Latch spring |
| 80 | no | 13A | Stand top Bracket |
| 81 | no | 13B | Stand top Bracket Bolts |
| 82 | no | 13A | Stand Leg Upper Support |
| 83 | no | 13A | Leg Bolt Hole |
| 84 | no | 13A | Stand Legs |
| 85 | no | 13A | Stand Centering Support Mount |
| 86 | no | 13A | Stand Bottom Support |
| 87 | no | 13A | Stand Foot |
| 88 | no | 13A | Stand Center Support Leg |
| 89 | no | 13A | Stand Center Support Bracket |
| 90 | no | 13A | Stand Center Guide |
| 91 | no | 14 | Led Light Projection |
| 92 | no | 14 | Led Light Illuminating Target Plate |
| 93 | no | 15D | Bullet |
| 94 | no | 15D | Arrow Showing Target Plate Falling Backward |
| 95 | no | 15E | Arrow Showing Target Plate/Recovery Mechanism |
| 96 | no | 15F | Arrow Showing Target Plate Nearly Recovered |
| 97 | no | 12 | Mounting path |
| 98 | no | 16 | Circuit Battery Pack |
| 99 | yes | 16 | Block Circuit Embedded Computer Controller |
| 100 | yes | 16 | Block Circuit Frame Mounted Devices |
| 101 | no | 16 | Voltage Regulators |
| 102 | no | 16 | Microcontroller |

-continued

SCHEDULE OF PARTS IN DRAWINGS:

| Part # | Assembly | FIGS. | Name |
|---|---|---|---|
| 103 | no | 16 | Led Power Supply/Driver |
| 104 | no | 16 | Motor Controller H-Bridge |
| 105 | no | 16 | Sensor Board Driver |
| 106 | no | 16 | Radio Circuit |
| 107 | no | 16 | Red Power Transistor (FET) |
| 108 | no | 16 | Green Power Transistor (FET) |
| 109 | no | 16 | Blue Power Transistor (FET) |
| 110 | no | 16 | White Power Transistor (FET) |
| 111 | no | 16 | Led Board Circuit |
| 112 | no | 16 | Drive Motor |
| 113 | no | 16 | Position Hit Sensor |
| 114 | no | 16 | Position Up Sensor |
| 115 | no | 16 | Position Middle Sensor |
| 116 | no | 16 | Position Bottom Sensor |
| 117 | no | 17 | Tablet Controller |
| 118 | no | 17 | Router |
| 119 | no | 17 | Bluetooth Signal |
| 120 | no | 17 | Target 1 |
| 121 | no | 17 | Target 2 |
| 122 | no | 17 | Additional Targets |
| 123 | no | 17 | Bluetooth Low Energy Long Range |
| 124 | no | 18 | Overview Target 1 |
| 125 | no | 18 | Overview Target 2 |
| 126 | no | 18 | Overview Target 3 |
| 127 | no | 18, 19 | Shooter |
| 128 | no | 18, 19 | Firearm |
| 129 | no | 19 | Perspective Depiction of Controller Tablet |
| 130 | no | 19 | Perspective Depiction of BLE to BLE LR Router |
| 131 | no | 19 | Perspective Depiction of Bluetooth Signal |
| 132 | no | 19 | Perspective Depiction of Target 1 of 3 |
| 133 | no | 19 | Perspective Depiction of Target 2 of 3 |
| 134 | no | 19 | Perspective Depiction of Target 3 of 3 |
| 135 | no | 19 | Perspective Depiction Bluetooth Long Range Signal |
| 136 | no | 20 | Timeline User Handheld Device |
| 137 | no | 20 | Timeline Wireless Router |
| 138 | no | 20 | Timeline Target 1 |
| 139 | no | 20 | Timeline Target 2 |
| 140 | no | 20 | Timeline Target (n) |
| 141 | no | 20 | Selected Timeline Block |
| 142 | no | 20 | Start Timeline Bock |
| 143 | no | 20 | Execution Timeline Block |
| 144 | no | 20 | End Timeline Block |
| 145 | no | 20 | Legend of Symbols |
| 146 | no | 20 | Target Up Symbol |
| 147 | no | 20 | Target Down Symbol |
| 148 | no | 20 | Target Hit Symbol |
| 149 | no | 20 | Target Negative Color Change |
| 150 | no | 20 | User Selects Drill |
| 151 | no | 20 | Upload Schedule for All Drills to Targets |
| 152 | no | 20 | User Clicks Start On Timeline |
| 153 | no | 20 | Start Signal is Transmitted to the Router |
| 154A | no | 20 | Start Signal is Transmitted to Target a |
| 154B | no | 20 | Start Signal is Transmitted to Target B |
| 154C | no | 20 | Start Signal is Transmitted to Target (n) |
| 155 | no | 20 | Timer Starts on User Tablet Application |
| 156 | no | 20 | Timers Start on all Targets |
| 157 | no | 20 | Events Executed per Schedule on all Targets |
| 158A | no | 20 | Target Goes Up on Target 1 |
| 158B | no | 20 | Target Goes Up on Target 2 |
| 159 | no | 20 | Target Sends "Hit" on Target 2 |
| 160 | no | 20 | Target Id ("2")/Timestamp Transmitted to Router |
| 161 | no | 20 | Router Relays Hit Signal to Application |
| 162 | no | 20 | Target Sends "Hit" on Target 1 |
| 163 | no | 20 | Router Relays Hit Signal to Application |
| 164A | no | 20 | Target "1" Goes Down |
| 164B | no | 20 | Target "2" Goes Down |
| 165 | no | 20 | Target (n) goes Up |
| 166 | no | 20 | Target (N) has a Negative Color Change |
| 167 | no | 20 | Target (N) is Hit in a Negative State |
| 168 | no | 20 | Target (N) Transmits Target Number/ Timestamp |
| 169 | no | 20 | Router Relays Hit Signal to Application |
| 170 | no | 20 | Target (N) Gets Down Signal per Timeline |
| 171 | no | 20 | No Remaining Events in Targets Schedules |
| 172 | no | 20 | Application Timer Expires / Scorecard Displayed |
| 173 | no | 21 | Main Menu Screen |

-continued

SCHEDULE OF PARTS IN DRAWINGS:

| Part # | Assembly | FIGS. | Name |
|---|---|---|---|
| 174 | no | 21 | User Selects Drill |
| 175 | no | 21 | Drill Briefing Displayed |
| 176 | no | 21 | User Selects Start Drill |
| 177 | no | 21 | Drill Run Routine Starts |
| 178 | no | 21 | User Completes Drill |
| 179 | no | 21 | Drill Scorecard Displayed |
| 180 | no | 21 | User Selects "Create/Edit Drill" |
| 181 | no | 21 | Drill Composer is Started |
| 182 | no | 21 | User Selects "View Leaderboard" |
| 183 | no | 21 | Leaderboard Viewer is Started |
| 184 | no | 21 | User Selects Setup System Option |
| 185 | no | 21 | Stage Setup is Displayed |
| 186 | no | 21 | User Selects Provision Targets |
| 187 | no | 21 | System Provisioning is Displayed |
| 188 | no | 22[A-F] | Tablet Software |
| 189 | no | 22A | Drill Carousel |
| 190 | no | 22A | Example Drill |
| 191 | no | 22A | "Run Drill" Button |
| 192 | no | 22A | "Setup" Button |
| 193 | no | 22B | "Drills Briefing" Title |
| 194 | no | 22[B-F] | "Back" Button |
| 195 | no | 22B | Drill Title Selected |
| 196 | no | 22B | "Required" Equipment and Supplies Field |
| 197 | no | 22B | "Drill Briefing" Text Field |
| 198 | no | 22B | "Next" Button to Start Drill |
| 199 | no | 22C | "Drills Start/Stop" Title |
| 200 | no | 22C | Drill Title |
| 201 | no | 22C | Drill Time Remaining |
| 202 | no | 22C | Drill Statistics (Real-Time) |
| 203 | no | 22C | "Drill Start" (/Stop) Button |
| 204 | no | 22D | "Scorecard Report" Title |
| 205 | no | 22D | "Shooter" Name Field |
| 206 | no | 22D | "Drill" Name of Scorecard |
| 207 | no | 22D | "Hits" Statistics for Scorecard |
| 208 | no | 22D | Totals of Hits/Misses/Points |
| 209 | no | 22D | "Hit/Miss per Target" Modal Averages |
| 210 | no | 22E | "Leaderboard" Title |
| 211 | no | 22E | Datatable - "Shooter" |
| 212 | no | 22E | Datatable - "Drill" |
| 213 | no | 22E | Datatable - "Score" |
| 214 | no | 22E | Datatable - "Affiliation" |
| 215 | no | 22E | Datatable - "Scrollbar" |
| 216 | no | 22F | "Drills Composer" Title |
| 217 | no | 22F | Drills Composer Instructions Text |
| 218 | yes | 22F | Target Arrangement on Shooting Stage |
| 219 | no | 22F | Target Number |
| 220 | no | 22F | Target in Up Position |
| 221 | no | 22F | Target in Down Position |
| 222 | no | 22F | Timeline |
| 223 | no | 22F | Drill Length Field |
| 224 | no | 22F | "Back/Cancel" Button |
| 225 | no | 22F | "Settings" Button |
| 226 | no | 22F | "Save" Button |
| 227 | no | 22F | "Previous Event" Button |
| 228 | no | 22F | "Stop" Button |
| 229 | no | 22F | "Play" Button |
| 230 | no | 22F | "Next Event" Button |
| 231 | no | 22F | "Delete Event" Button |
| 232 | no | 22F | Color Selector for Led Illumination |
| 233 | no | 22G | "System Stage Setup" Title |
| 234 | no | 22G | "Stage selector" dropdown |
| 235 | no | 22G | Target location |
| 236 | no | 22G | Distance between target indicator |
| 237 | no | 22G | Shooter icon |
| 238 | no | 22H | "System Provisioning" title |
| 239 | no | 22H | "Search for Targets to Add" button |
| 240 | no | 22H | "Auto Add Targets" button |
| 241 | no | 22H | "Targets Found" display |
| 242 | no | 22H | MAC addresses of Targets |
| 243 | no | 22H | Status of Targets |
| 244 | no | 22H | "Identify" link |
| 245 | no | 22H | "Add" Target link |
| 246 | no | 22H | "Change number" button |
| 247 | no | 22H | "Forget" target button |

BRIEF DESCRIPTION OF THE DRAWINGS

The Dynamic Automatic Reactive Target system is comprised of four major components: one or more electromechanical targets; a computerized controller (most practically, a tablet computer), with which a user interacts; an application that runs on the computerized controller, and one or more training programs, termed drills, that activate the target(s) via a time coordinated schedule of commands.

A detailed explanation of each figure follows.

The Top Drive Idle Shaft (41) has mounted on it the Top Drive Idle Sprocket (42) and the Linear-Spring Bushing (43) and the Linear Spring Bushing Bearings (45), allowing them to rotate around said Top Drive Idle Shaft's (41) axis. Mounted around the Linear-Spring Bushing (43) are the Linear-Springs (44). The Front Outer Idler Sprocket (46) supports the Transit Drive Chain (33), as mounted on the Front Outer Idler Sprocket Shaft (47), between the Elevator Assembly Outer Shaft Mounting Plate (48) and the Elevator Assembly Mount (35). The Front Outer Idler Sprocket (46) is supported by the Idler Sprocket Bearing (49), and aligned with the Idler Sprocket Shaft Spacer (50), allowing for reduced mechanical friction. The Front Inner Idler Sprocket (51) serves a similar purpose as the Front Inner Idler Sprocket (51), supporting the inner stretch of the Transit Drive Chain (33). It is aligned via the Elevator Bracket Spacer (52). Tension on the Transit Drive Chain (33) is provided via the Tension Sprocket (53), mechanically linked to the arm by the that is affixed to the Front Inner Idler Sprocket Shaft (54). Said Tension Sprocket (53) is mounted to the Sprocket Tensioning Arm (97). Tension is provided to said Transit Drive Chain (33) via the Tension Arm Spring (58), mechanically afield via the Tension Spring Clip (59), with its axis mounted around the Tension Spring Bushing (55). Said Tension Spring Bushing (55) is aligned horizontally via the Tension Arm Spacing Washer (57), with rotational friction of the Front Outer Idler Sprocket (46) reduced by the Tension Arm Bearing (56).

Figure 1:
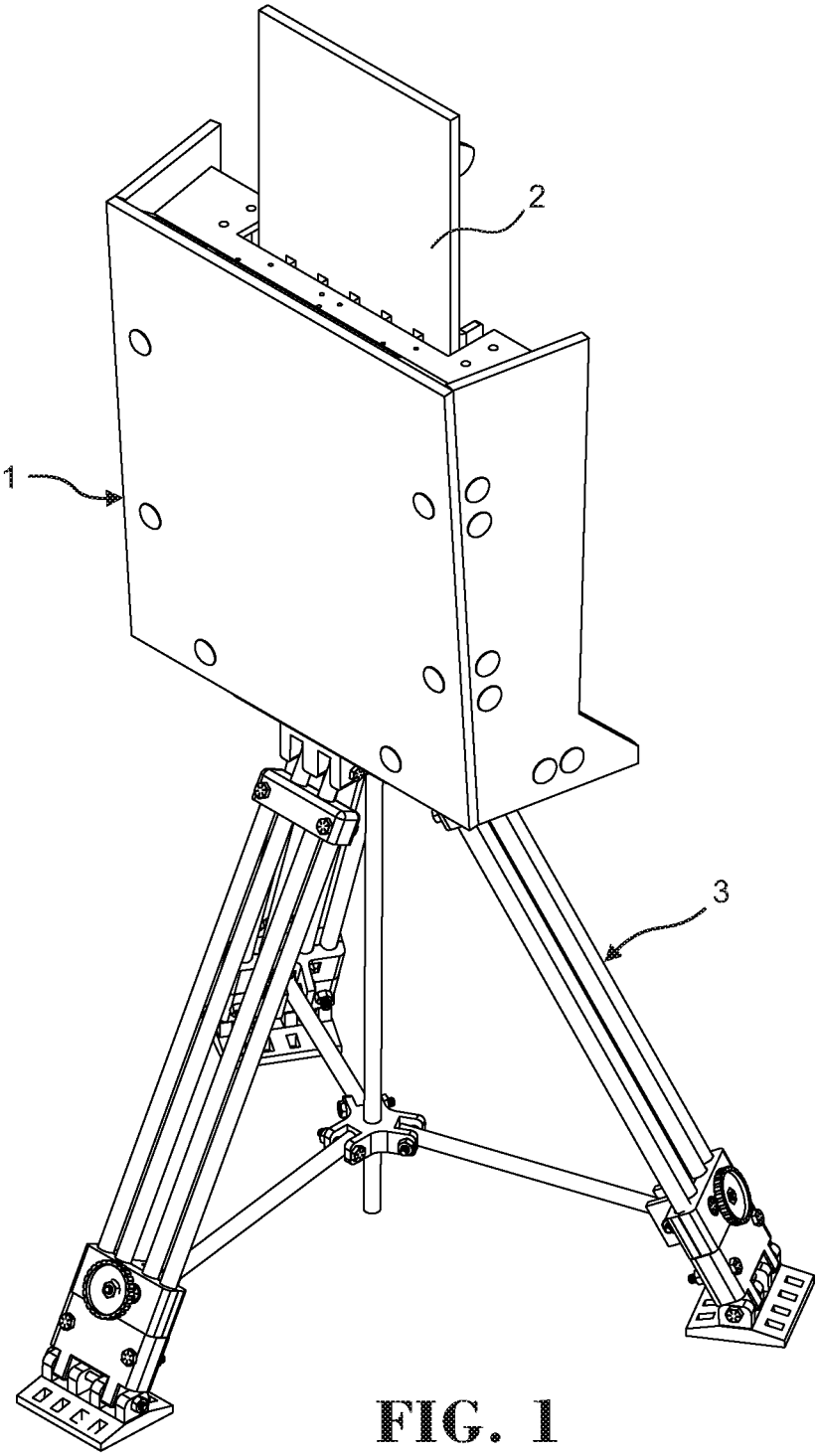
FIG. 1 shows the Target Unit Assembly (1), containing a Target Plate (2) that can be moved via electromechanics up, down, and sense "hits" to the plate. The Target Unit Assembly (1) is mounted upon the supporting Stand Assembly (3). The Target Unit Assembly (1) comprises mechanisms to allow for the Target Plate's (2) vertical movement and ability to absorb impacts from being shot by a projectile.
Figure 2:
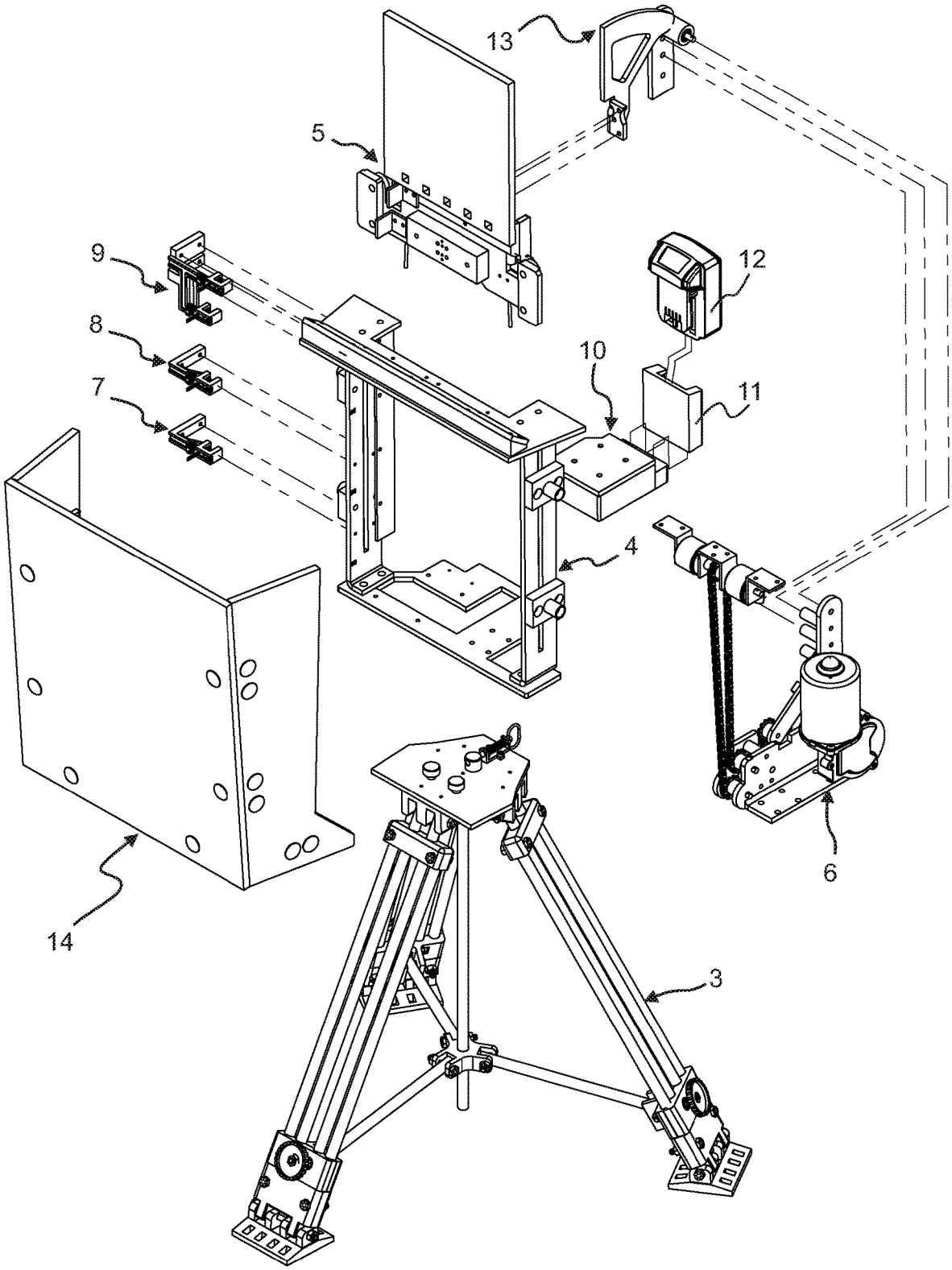
FIG. 2 depicts the major subsections of the Target Unit Assembly (1). These include the Chassis Assembly (4) upon which all other assembly parts for the Target Unit Assembly (1) are mounted. Mounted to the Chassis Assembly (4), is the Transit Assembly (5), designed to move up and down, in a track within the Chassis Assembly (4), moved by the Elevator Assembly (6). Mounted to the Chassis Assembly (4), are three position sensors: the Optical Interrupt Assembly Bottom (7), Optical Interrupt Assembly Middle (8), and Optical Interrupt Assembly Top and Hit (9) sensors, designed to detect when they are blocked and electrically transmit this to the Embedded Computer Motherboard. The Embedded Computer Box Assembly (10) is mounted to the Chassis Assembly (4). The Embedded Computer Box Assembly (10) has to it attached mechanically and electrically a Battery Holder (11), and Battery (12). Attached to the Transit Assembly (5) is a Recovery Assembly (13). The Recovery Assembly (13) is designed to absorb the Target Plate (2) impact after being hit, and falling backward, vertically as the Target Plate is pulled downward by the Elevator Assembly (6). The Chassis Assembly (4) and all the parts that comprise it, are placed into a socketed, easily removable, Shield Assembly (14), protecting the internal parts of the Target Unit Assembly (1).
Figure 3:
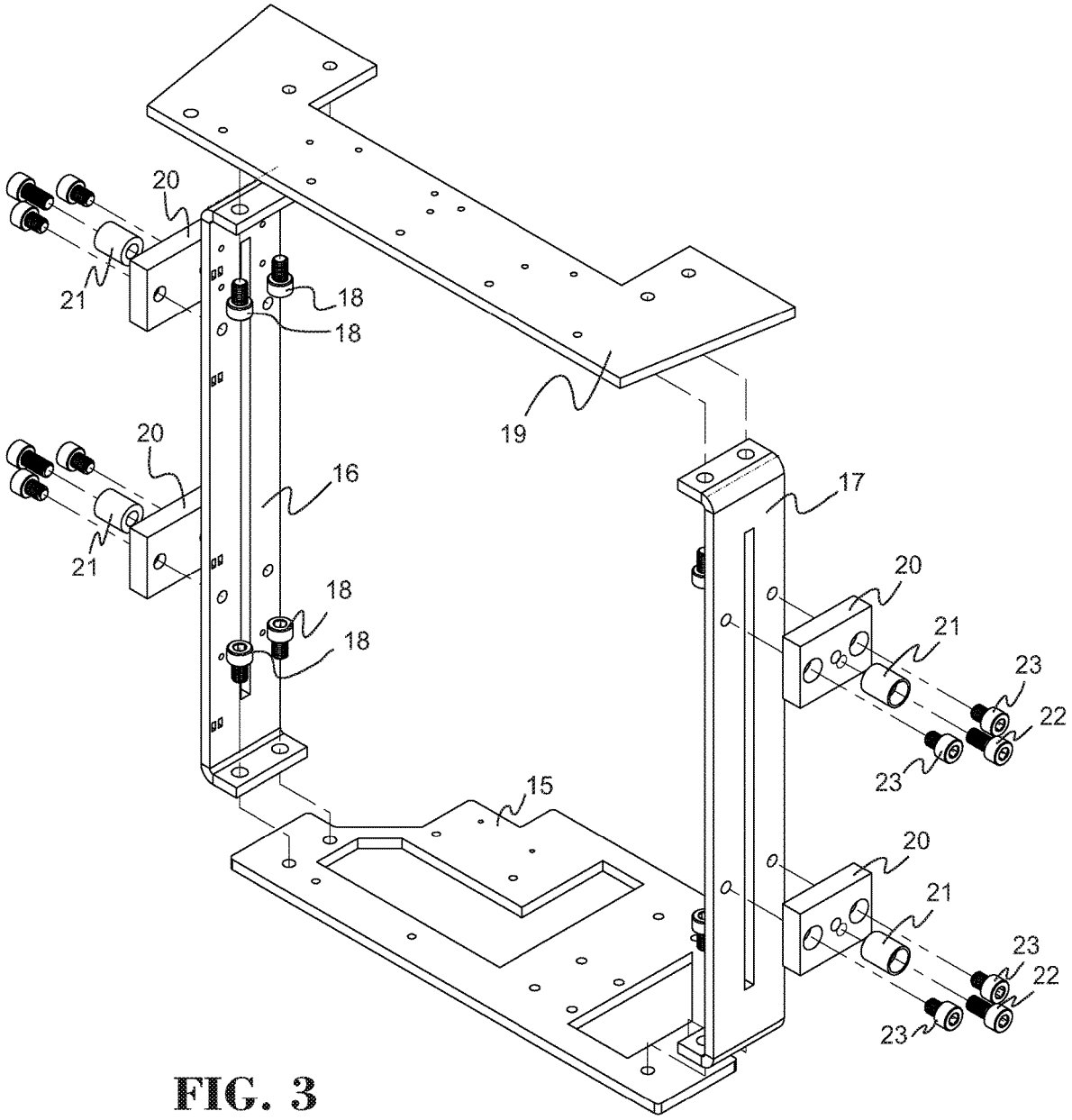
FIG. 3 shows how the Chassis Assembly (4) is comprised of a Chassis Base (15), two vertical tracks/supports—Chassis Vertical Track Left (16) and Chassis Vertical Track Right (17), and the Chassis Top (19), attached via the Chassis Vertical Track Screws (18). On either side of the Chassis Vertical Tracks, Left (16) and Right (17), are two frame mounts allowing the Chassis Assembly (4) to be easily mounted and unmounted from the Shield Assembly (14). The mount consists of a Frame Mount (20), Frame Mount Peg (21), and Frame Mount Peg Bolt (22) that affixes the Frame Mount Peg (21) to the Frame Mount (20). The Frame Mount (20) is attached to the Chassis Vertical Tracks, Left (16) and Right (17), via Frame to Vertical Track Bolts (23).
Figure 4:
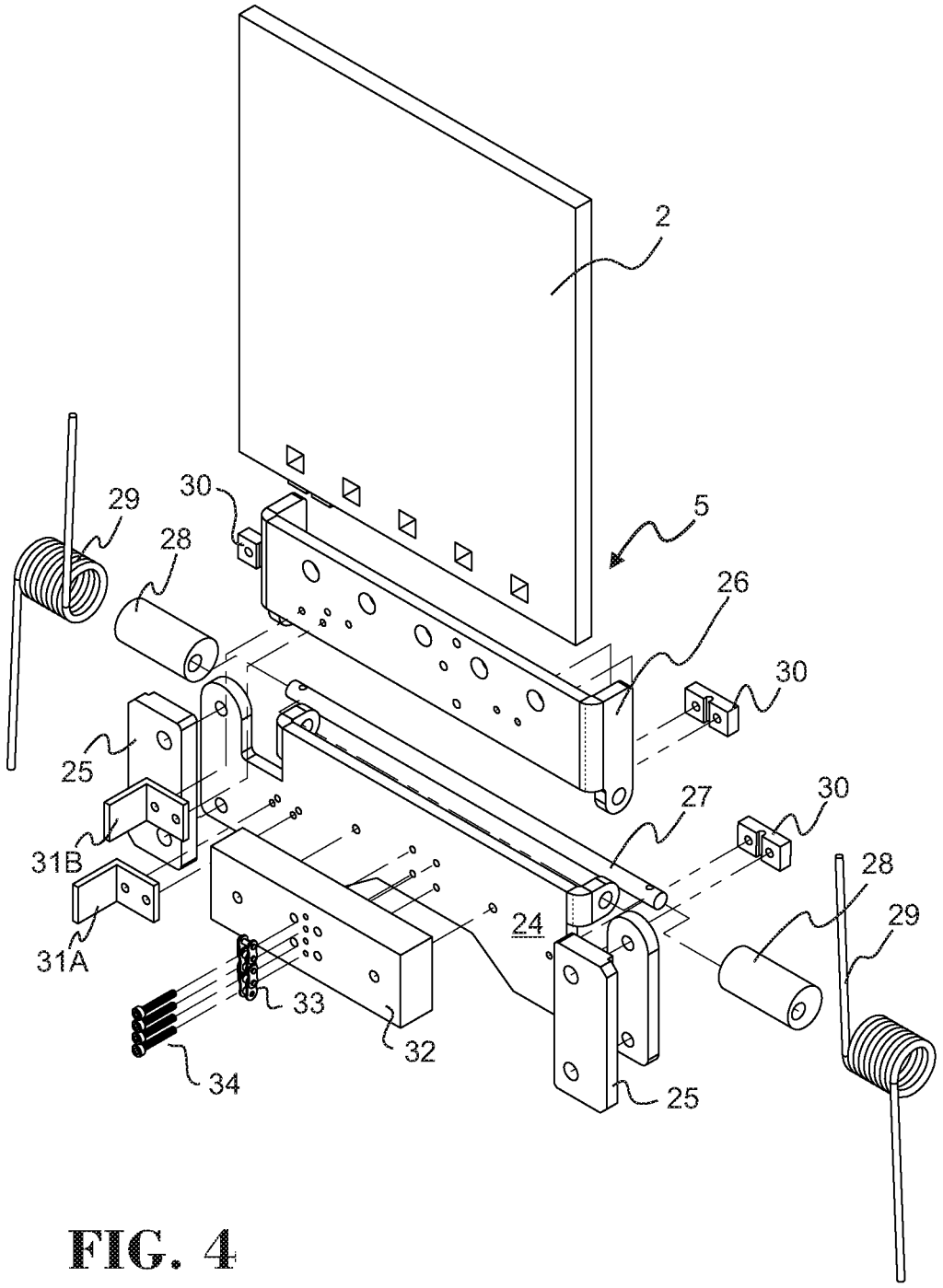
FIG. 4 depicts the Transit Assembly (5). The Transit Assembly (5) comprises the Transit Frame (24), and Transit Vertical Guides (25), allowing the Transit Assembly (5) to be moved up and down in the slots provided by the Chassis Vertical Tracks, Left (16) and Right (17). On the Transit Frame (24), a Transit Frame Target Plate Mount (26) can freely pivot around the axis of the Transit Frame Pivot Pin (27). The Transit Frame Pivot Pin (27) provides a hinge action, and the retention of the Transit Frame Target Plate Mount (26), to the Transit Frame (24). The Target Plate (2) is firmly affixed to the Transit Frame Target Plate Mount (26) via a series of bolts (not shown in FIG. 4). When the Target Plate (2) is shot, it falls backward, pivoting around the Transit Frame Pivot Pin (27) axis. This downward impact force is slowed by the Transit Recovery Spring (29). The Transit Recovery Spring (29) is aligned via the Transit Recovery Spring Bushing (28), and held in place to the Transit Frame (24) and Transit Frame Target Plate Mount (26), by the Transit Recovery Spring Clip (30). Affixed to the Transit Frame (24), is Optical Interrupt Tab for the Transit (31A). Affixed to Transit Frame Target Plate Mount (26) is Optical Interrupt Tab for Target Hit (31B). Said interrupt tabs block the Optical Interrupts light path to indicate their position. The Transit Frame (24) is connected to the Transit Drive Chain (33), by way of the Transit Chain Mount Block (32), through the use of the Drive Chain Screws (34).
Figure 5:
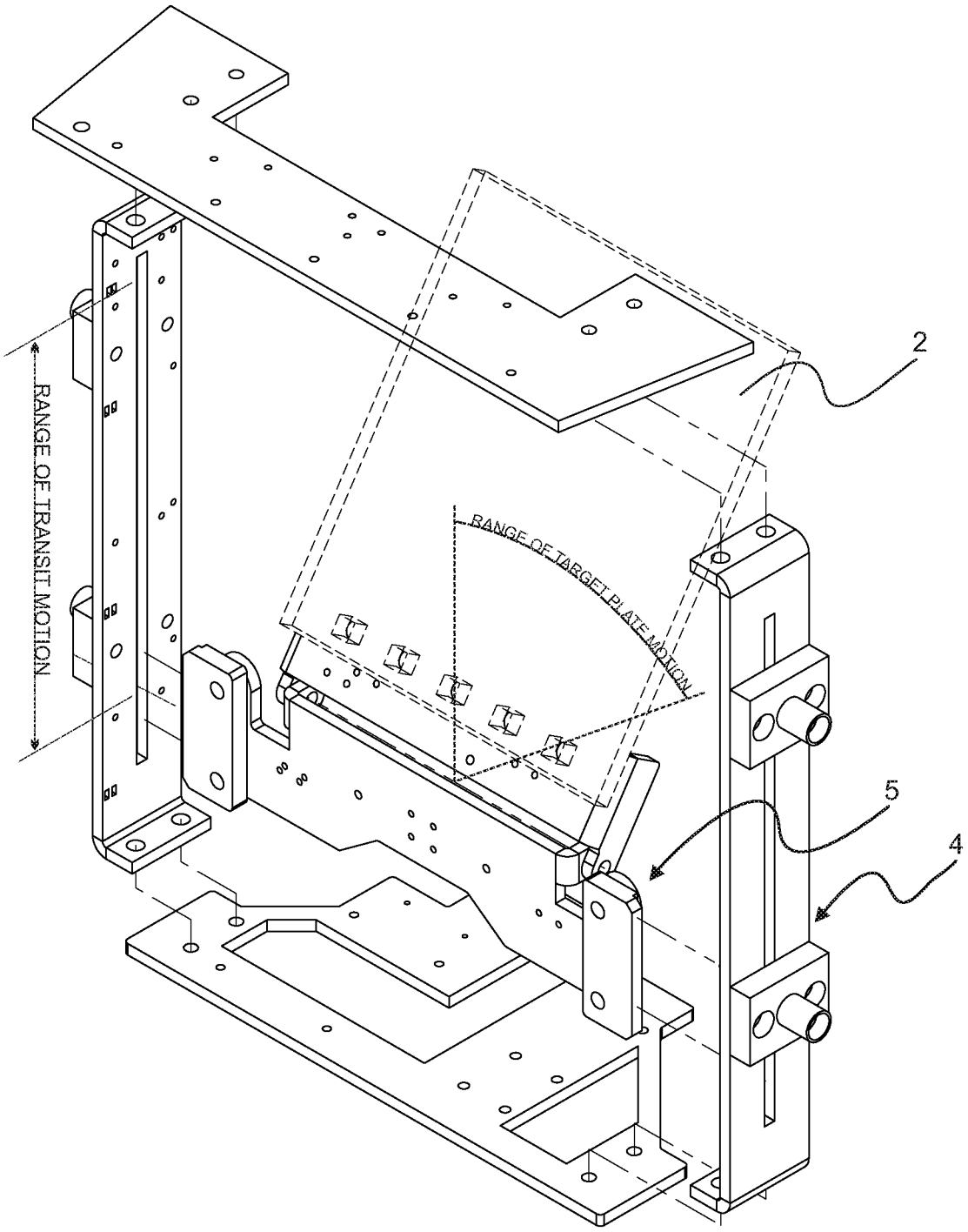
FIG. 5 shows the ranges of motion of the Transit Assembly (5), as mounted within the Chassis Assembly (4). In addition, it shows how the Target Plate (2) has a range of motion as it can pivot from vertical to the "hit" position.
Figure 6:
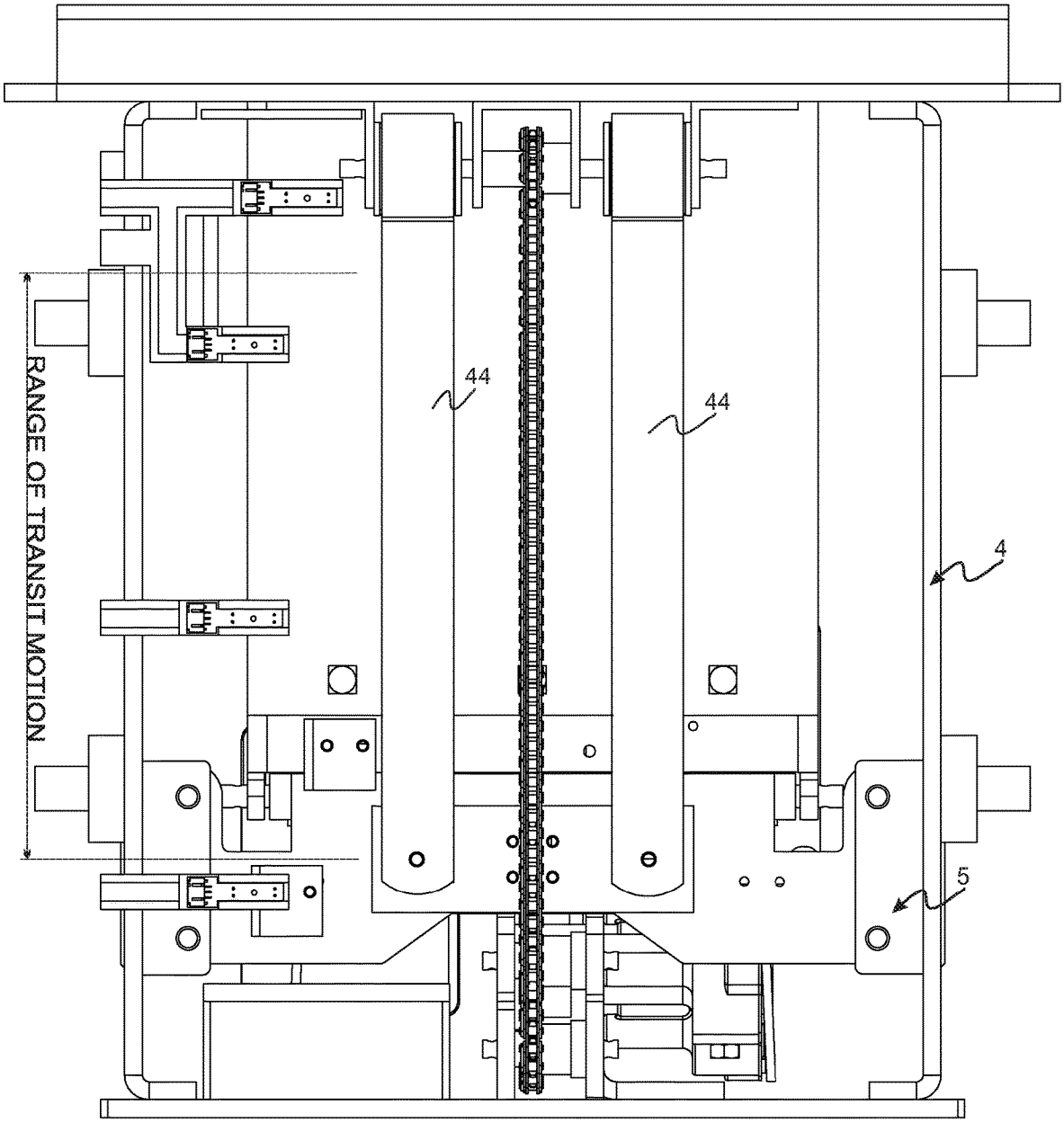
FIG. 6 depicts the Linear-Springs (44), connected to the Transit Assembly (5), and supported by the Chassis Assembly (4). Said Linear-Springs (44) compensate for the weight of the Transit Assembly (5), and act as a ballast force in the mechanical system, reducing energy consumption and the ability for the increased upward speed of travel.
Figure 7:
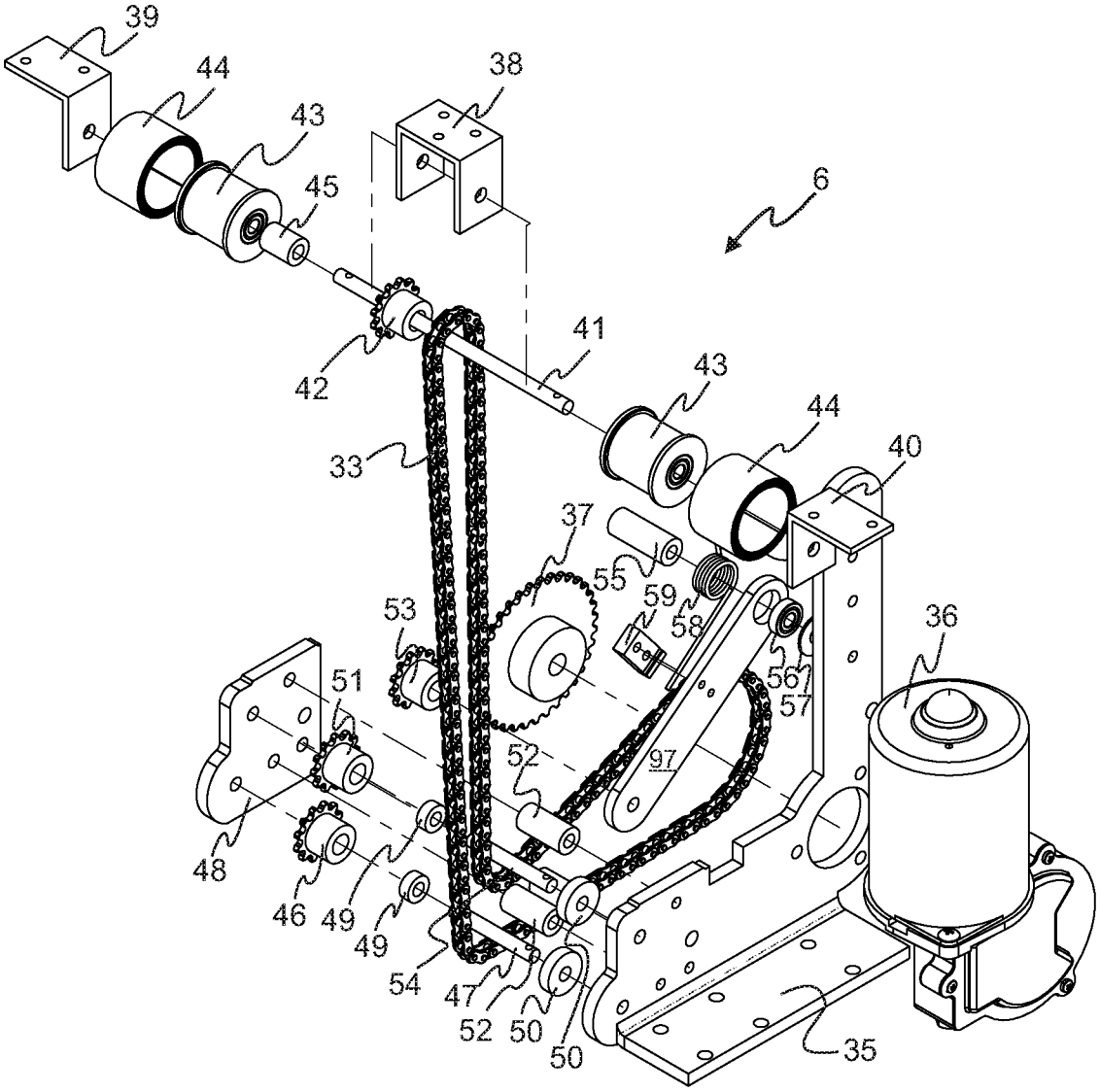
FIG. 7 depicts the Elevator Assembly (6). The assembly is built upon the Elevator Assembly Mount (35), which is affixed to the Chassis Assembly (4). A Drive Motor (36) is mounted to the Elevator Assembly Mount (35). Affixed to the Drive Motor's (36) shaft is Drive Sprocket (37). The Elevator Top Drive Support Center Bracket (38), Elevator Top Drive Support Left Bracket (39), and Elevator Top Drive Support Right Bracket (40) support the Top Drive Idle Shaft (41).
Figure 8:
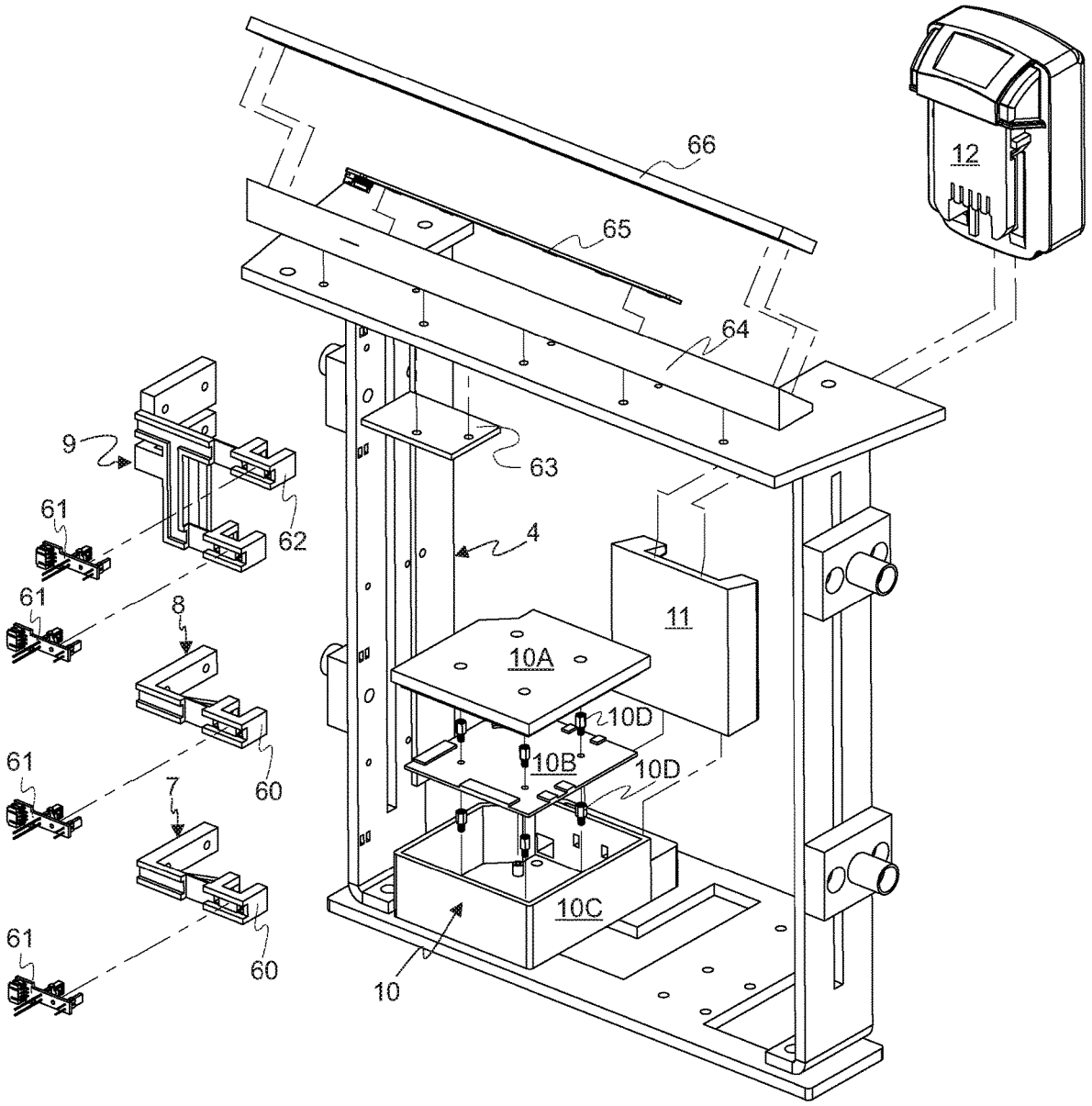

FIG. 8 shows how the electrical components are mechanically affixed to the Chassis Assembly (4). The Computer Box Assembly (10) consists of the Embedded Computer Box Cover (10A) to encases the assembly, the Embedded Computer Motherboard (10B) as mounted to the Embedded Computer Box (10C), via the Embedded Computer Mounting Screws (10D). Attached to the Embedded Computer Box Assembly (10) is the Battery Holder (11), which supports and electrically connects the Battery (12). Said Battery (12) provides power to all the electronics in the system. On the Chassis Assembly (4), rigidly mounted to it are the Optical Interrupt Assembly Bottom (7), Optical Interrupt Assembly Middle (8), and Optical Interrupt Assembly Top And Hit (9) assemblies. These assemblies consist of the brackets, Optical Interrupt Bracket For Bottom and Middle (60) sensors, and the Optical Interrupt Assembly Top and Hit Bracket (62). Each of these brackets contains an Optical Interrupt Circuit Board (61) that consists of an infrared light source ("IR LED"), and IR phototransistor, capable of sensing the presence or absence of the IR LED light as they are blocked by the Optical Interrupt Transit Tab (31A, not shown in this drawing) and Target Tab (32B, not shown in this drawing). Due to the close positioning of the mechanical parts, an Optical Interrupt Debris Shield (63) is affixed to the Chassis Assembly (4), to protect the sensor parts from projectile debris and shrapnel. Illumination of the Target Plate (2) is provided by an Illuminator Led Circuit Board (65). Said Illuminator LED Circuit Board (64) is mounted on to Illuminator Base (64), providing ideal illumination angles for projecting light onto the Target Plate (2), and acting as a heat sink to mitigate the LED heat produced while illuminated. The Illuminator Led Circuit Board (65) is shielded from debris by a replaceable Illuminator Clear Shield (66) made of a translucent or transparent shield, such as polycarbonate, mounted to the Illuminator Base (64).

Figure 9A:
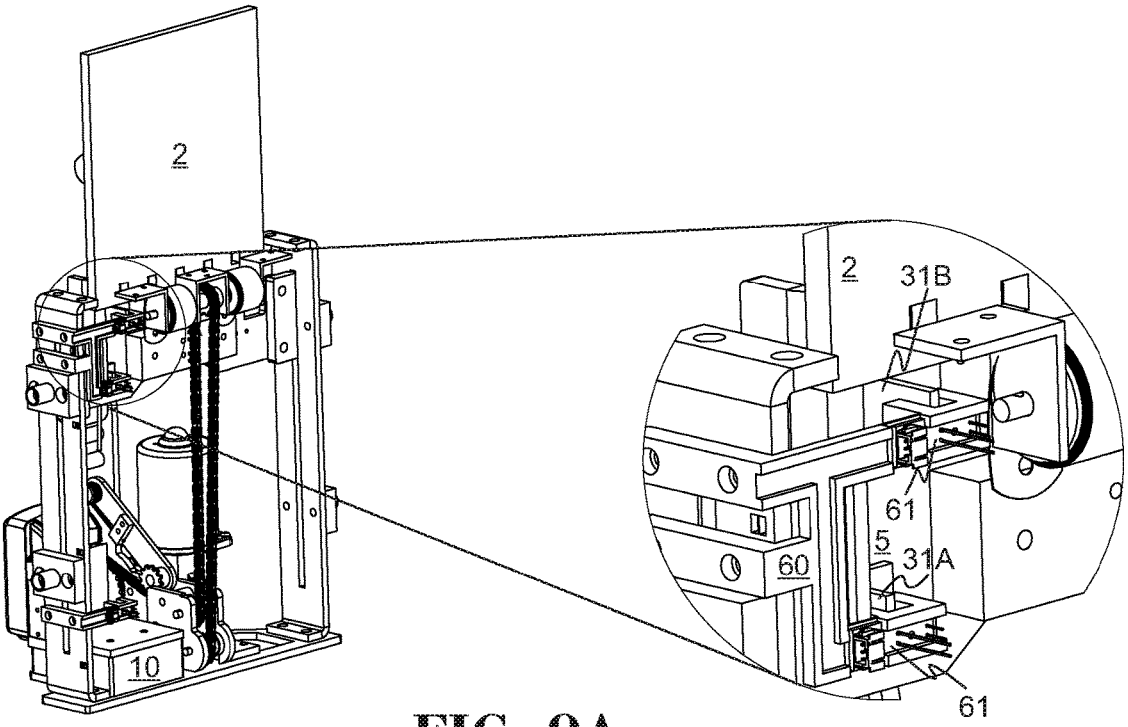
Figure 9B:
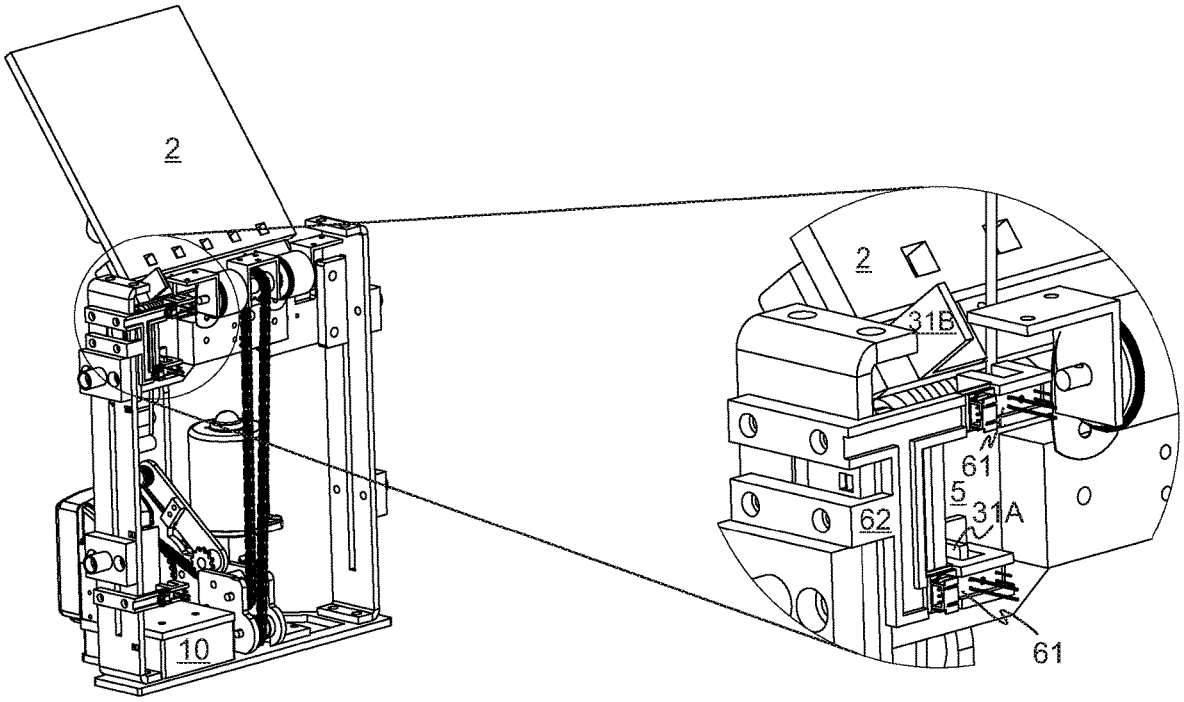

FIGS. 9A and 9B depict the operation of the optical interrupt system. While other systems of position detection could be implemented, such as Hall Effect ("HAL") sensors, magnetic reed switches, and physical contact switches, the preferred embodiment is pictured utilizing an optical interrupt system. There are two categories of optical interrupt systems used—the target hit sensor, and the transit position sensors ("Bottom", "Middle", and "Top"). The Hit sensor indicates when the target plate has been impacted. The position sensors indicate the location of the transit system (and therefore the vertical location of the Target Plate (2)).

In FIG. 9A, the Target Plate (2) is shown in the vertical, "non-hit" state, and the transit that moves vertically the Target Plate (2) is shown in the top most position. The Target Plate (2) has rigidly affixed to it the Optical Interrupt Target Tab (31B). This tab, blocks, or interrupts the optical path of the Optical Interrupt Circuit Board (61). Said Optical Interrupt Circuit Board (61) is connected to the Embedded Computer Box Assembly (10), and is held rigidly to the Chassis Assembly (4) via the Optical Interrupt Assembly Top and Hit Bracket (62). The Optical Interrupt Transit Tab (31A) is similarly, rigidly affixed to the Transit Assembly (5). The Optical Interrupt Transit Tab (31A) blocks another Optical Interrupt Circuit Board (61). Said Optical Interrupt Circuit Board (61) is connected to the Embedded Computer Box Assembly (10), allowing the transit top position to be indicated to the Embedded Computer Motherboard (10B, not shown in FIG. 9A or 9B).

In FIG. 9B, the target plate (2) can be seen starting to fall backward, after being "hit" by a bullet. This causes said Target Plate (2), upon which the rigidly affixed Optical Interrupt Target Tab (31B) is mounted, to rise upward, out of the top Optical Interrupt Circuit Board (61) light path. This causes an electrical signal to be sent to the Embedded Computer Motherboard (10B, not shown in FIG. 9A or 9B), mounted inside the Embedded Computer Box Assembly (10), to register the state change. Since the Transit Assembly (5) has not moved in this example, the lower Optical Interrupt Circuit Board (61) is still blocked by the Optical Interrupt Transit Tab (31A).

Figure 10:
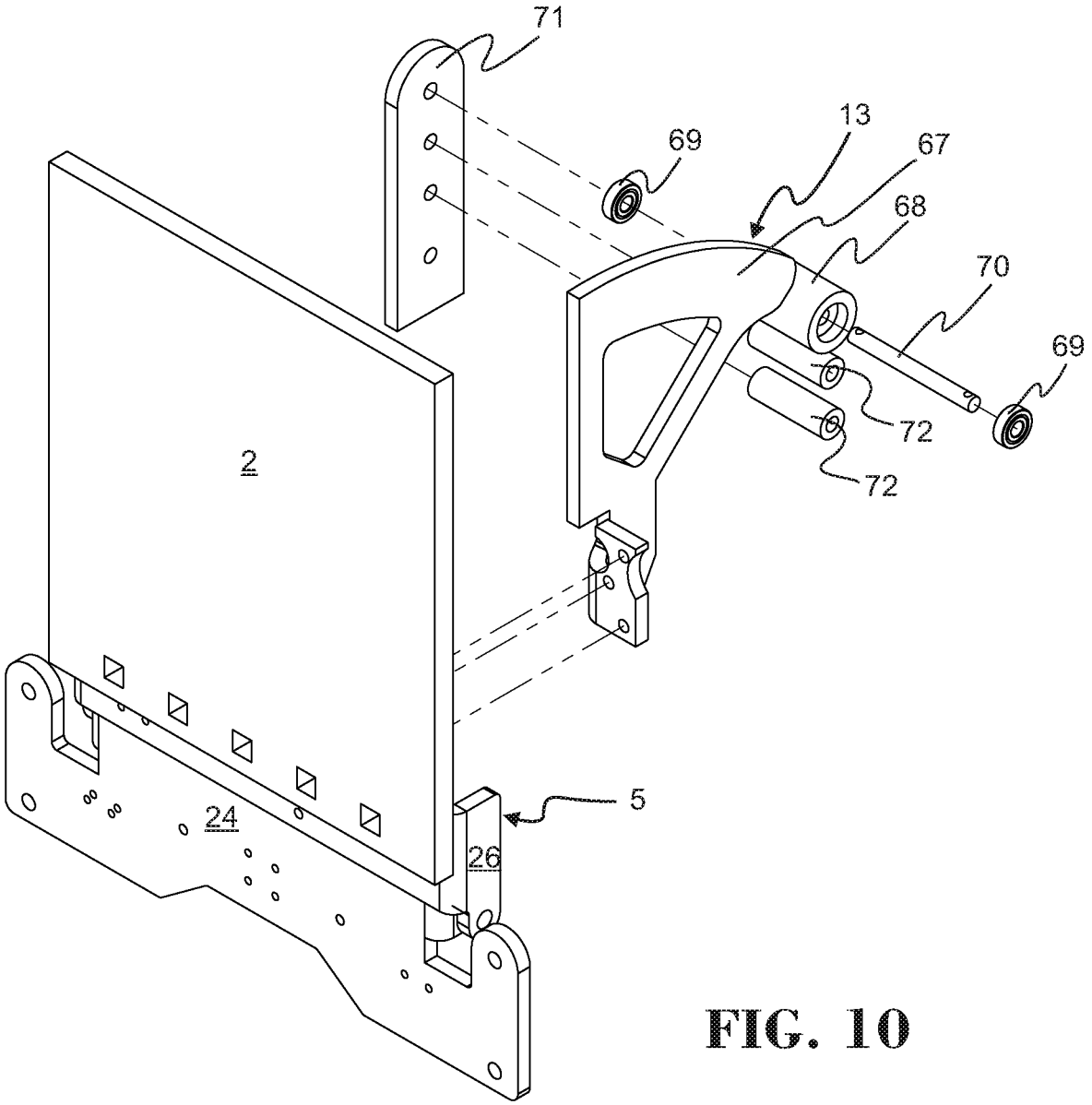

FIG. 10 depicts the Recovery Assembly (13). The Transit Frame (24) is mounted to it via a pivot pin (not shown in FIG. 10), the Transit Frame Target Plate Mount (26), as part of the Transit Assembly (5). Mounted via bolts onto the Transit Frame Target Plate Mount (26) is the target's Target Plate (2). This allows the Target Plate (2) and the Transit Frame Target Plate Mount (26) to pivot backward by about 90 degrees when "hit" by a bullet. In order to limit the angle of travel, and assist in standing the Target Plate (2) back into the vertical position, the Recovery Assembly (13) is used. Rigidly affixed to the Transit Frame Target Plate Mount (26) is a Recovery Foot (67). The Recovery Foot (67), is aligned with the Recovery Bushing (68), designed to absorb the impact from the Recovery Foot (67), and reduce friction as the Recovery Foot (67) is pulled downward and upward against the Recovery Bushing (68). The Recovery Bushing (68) has Recovery Bushing Shaft Bearings (69), that allow the Recovery Bushing Shaft (70) to rotate with reduced friction, supported by Recovery Shaft Mount Plate Cover (71), and reinforced as well as aligned via the Recovery Spacers (72). This operation is better visualized in FIGS. 15[A-F].

Figure 11:
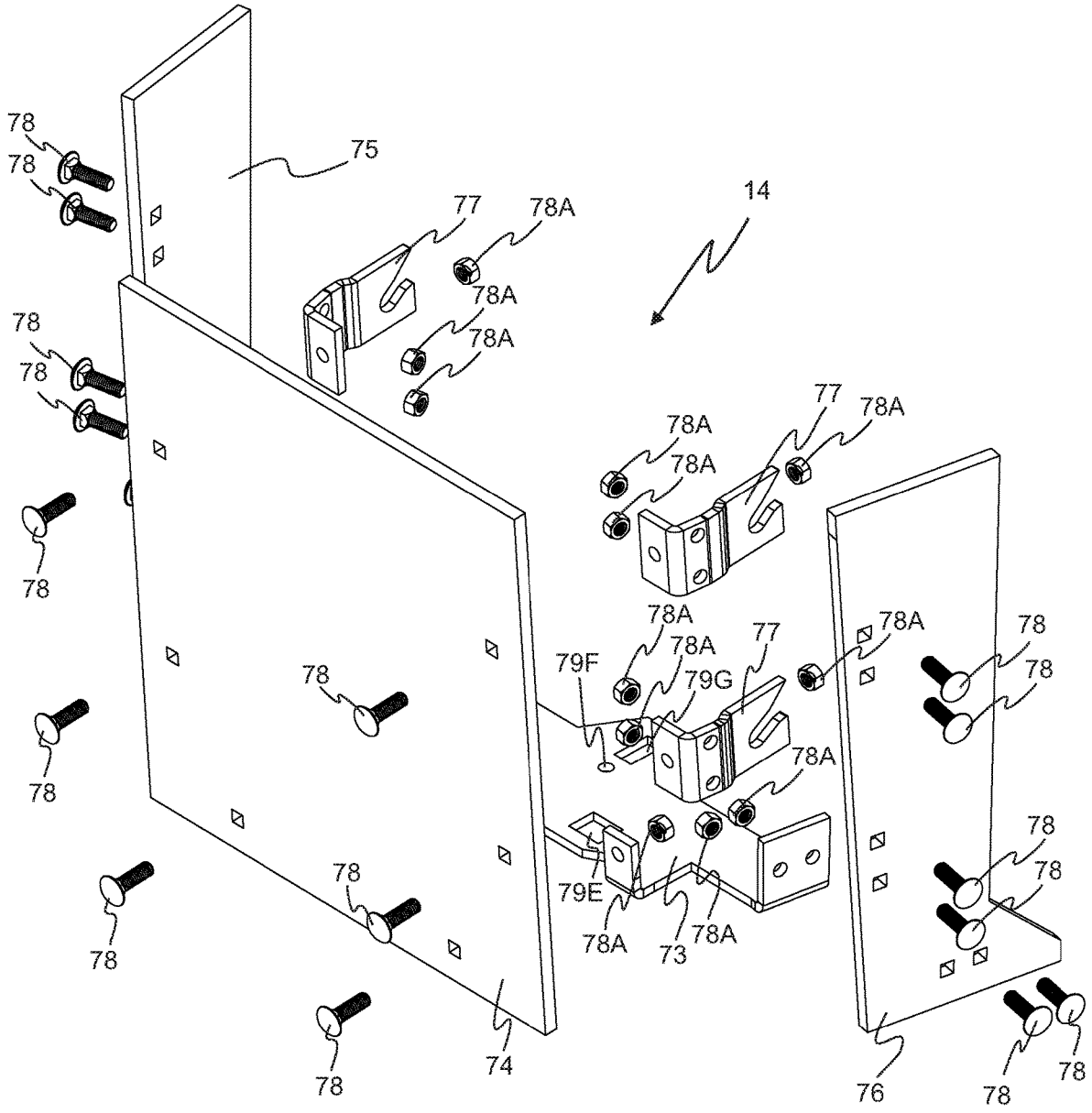

FIG. 11 depicts the Shield Assembly (14). The assembly is built upon the Shield Base (73). The Shield Base (73) allows for all parts of the Shield Assembly (14) to be attached, as well as the Shield Assembly (14) to be mounted via a mounting system of holes and fasteners to a Stand Assembly (3, not shown in FIG. 11). The Front Shield (74), Left Shield (75), and Right Shield (76) are affixed to four Receiver Mounting Brackets (77) via a series of Shield Bolts (78) and Shield Bolt Nuts (78A). The Receiver Mounting Brackets (77) allow for the angle of the various shield plates to be maintained, while providing a reward pointing slot to allow for the simplified insertion and removal of the Chassis Assembly (4, not shown in FIG. 11). Mounting holes in the Shield Assembly Base (73), depicted by Stand Hook Hole (79E), Stand Locking Pin Hole (79F), and Stand Latch Hole (79G) will be explained in FIG. 13.

Figure 12:
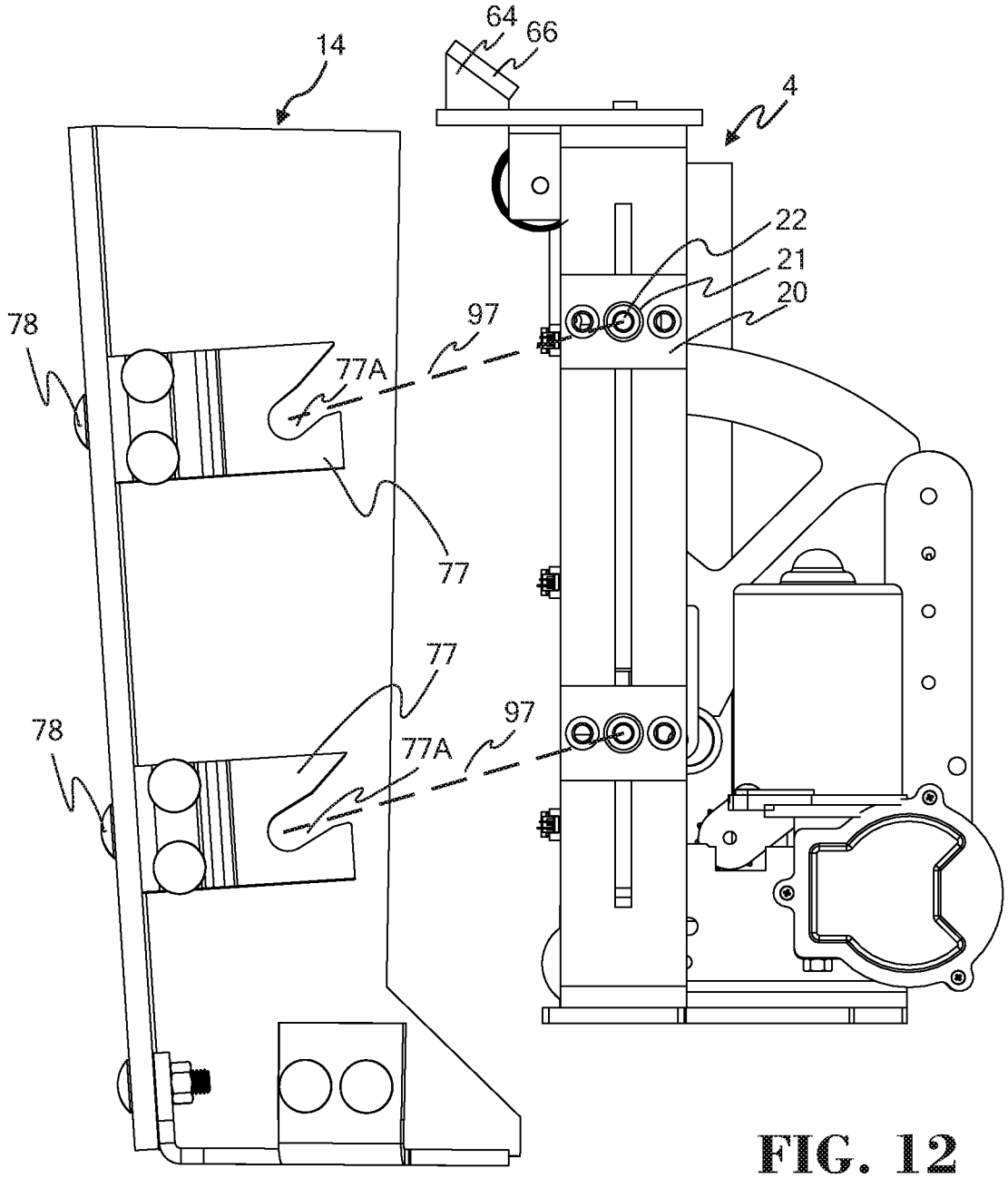
Figure 13A:
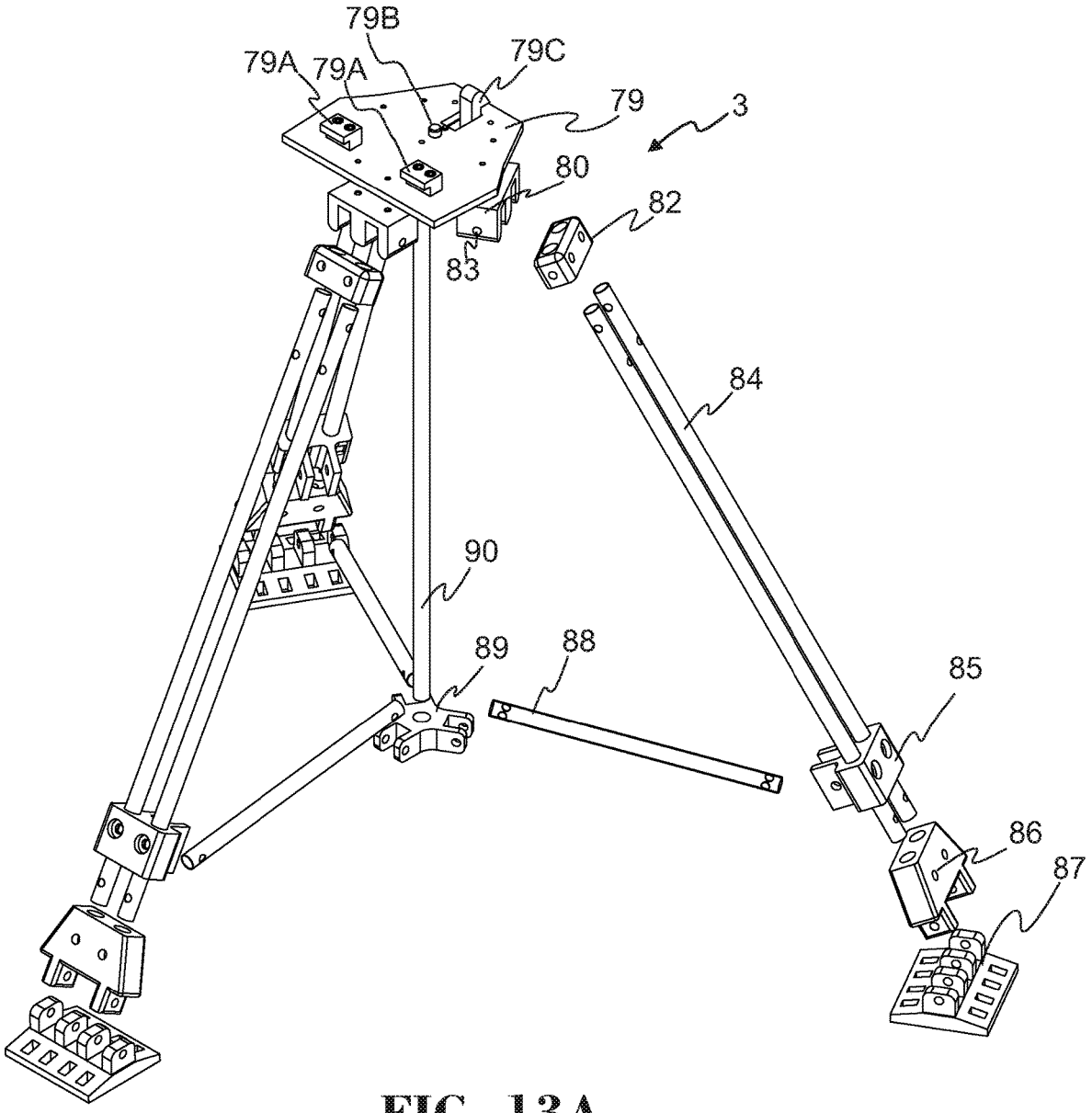
Figure 13B:
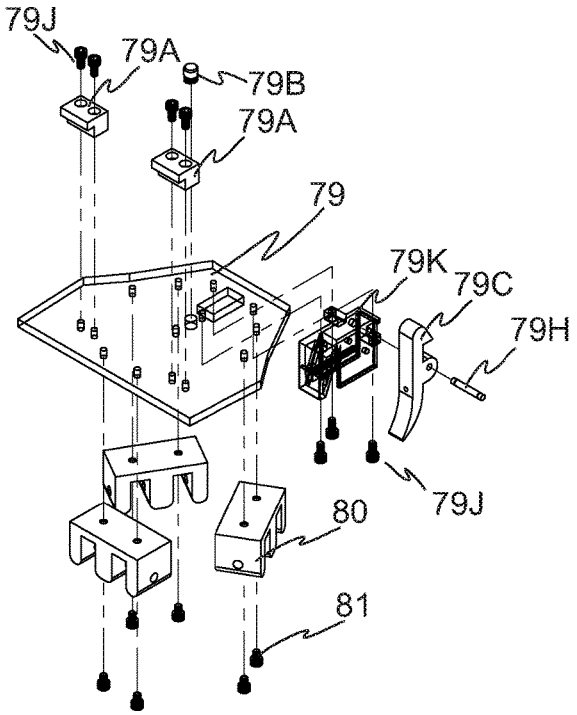
Figure 13C:
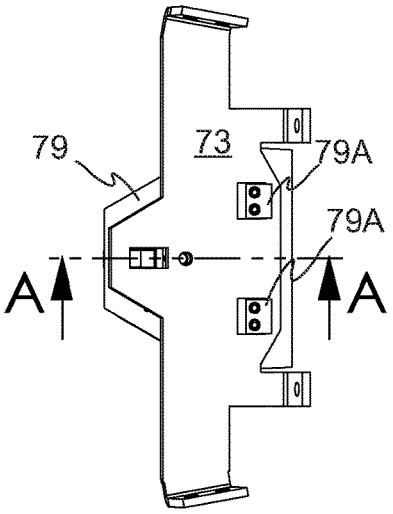
Figure 13D:
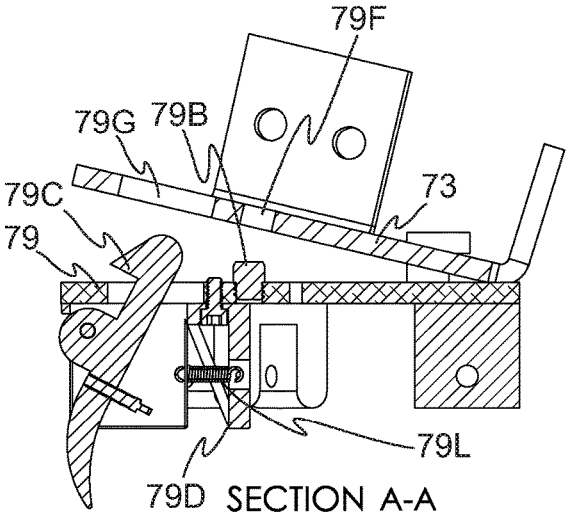
Figure 13E:
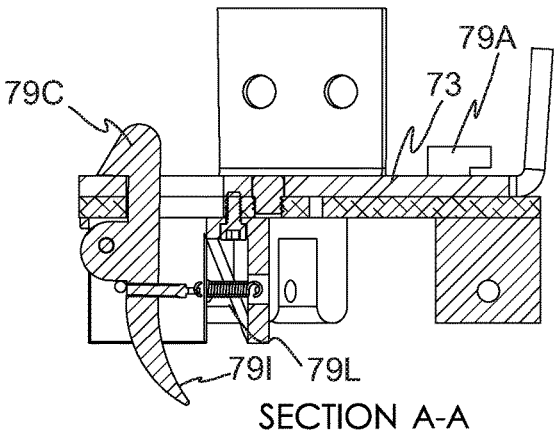

FIG. 12 shows the Chassis Assembly (4) mounting method to the Shield Assembly (14). The Shield Assembly (14) has affixed to it four Receiver Mounting Brackets (77), by the Shield Bolts (78) and Shield Bolt Nuts (78A). The Receiver Mounting Bracket (77) has contoured Receiver Slots (77A), designed to receive the Frame Mount Pegs (21). These Frame Mount Peg (21) are inserted along the Mounting path (97) angle, and are held in place due to the geometry of the slot and the weight of the Chassis Assembly (4). The Frame Mount Pegs (21) are affixed to the Frame Mount (20) by the Frame Mount Peg Bolt (22). This creates four rigid mounting points for the Chassis Assembly (4) to be supported by the Shield Assembly (14). The Illuminator Base (64) and Illuminator Clear Shield (66) will be described further, when discussing FIG. 15.

FIGS. 13[A-E] depict the Stand Assembly (3), and how it mounts to the Shield Base (73). FIG. 13A shows a fixed height stand mechanism. The Stand top (79) has a number of fasteners designed to mate with reciprocal Shield Base (73) features. There are two Stand top Hooks (79A) that lock into the Stand Hook Holes (79E, FIG. 11), a Stand Locking Pin (79B) that mates into the Stand Locking Pin Hole (79F, FIG. 11), and the spring loaded Stand Latch (79C) designed to mate with the Stand Latch Hole (79G, FIG. 11). Mounted to the bottom of the Stand top (79) are three Stand Top Brackets (80). A set of nuts and bolts (not shown) pass the Leg Bolt Holes (83) through mating holes in the Stand Legs (84). Also on the top of the Stand Legs (84) are Stand Leg Upper Supports (82). The bottom of the Stand Legs (84) have an adjustable Stand Centering Support Mount (85), and Stand Bottom Support (86). The Stand Bottom Support (86) is affixed to large Stand Feet (87) that swivel to match the angle of the ground upon which the stand is placed. To keep the distance from the Stand Centering Support Mount (85), three Stand Center Support Legs (88) are used, and mounted to a central Stand Center Support Bracket (89), guided vertically on the Stand Center Guide (90).

FIG. 13[B] describes in detail the brackets mounted to the bottom of the Stand top (79). The Stand top Hooks (79A) are attached to the Stand top (79) via the Latch bolts (79J). The Stand Locking Pin (79B) is threaded into the Stand Top (79). The Latch frame (79K) is mounted to the Stand top (79) via a Latch bolt (79J). Into the Latch frame (79K), the Stand Latch Pin (79H) provides a pivot for the Stand Latch (79C). On the bottom of the Stand top (79), the Stand top Brackets (80) are shown being affixed via the Stand top Bracket Bolts (81).

FIG. 13[C] shows the Shield Base (73) mounted on the Stand top (79), and the protruding Stand top Hooks (79A). Section "A-A" of FIG. 13[C] is visible in FIGS. 13[D] and 13[E].

FIG. 13[D] depicts the Shield Base (73) being lowered onto the Stand top (79). The Stand Locking Pin (79B) is in alignment with the Stand Locking Pin Hole (79F). The Stand Latch (79C) is in the open position, being pulled against by the tension of the Latch spring (79L), ready to snap back into the Shield Base's (79) Stand Latch Hole (79G).

FIG. 13[E] shows the Shield Base (73) fully mounted to the Stand top (79) in the locked position. The Stand top Hook (79A) prevents the Shield Base (73) from being lifted vertically in the front and the Stand Latch (79C) in the rear. A user can detach the Shield Base (73) from the Stand top (79) easily via pulling on the Stand Latch Pull Point (79I) against the Latch spring (79L).

Figure 14:
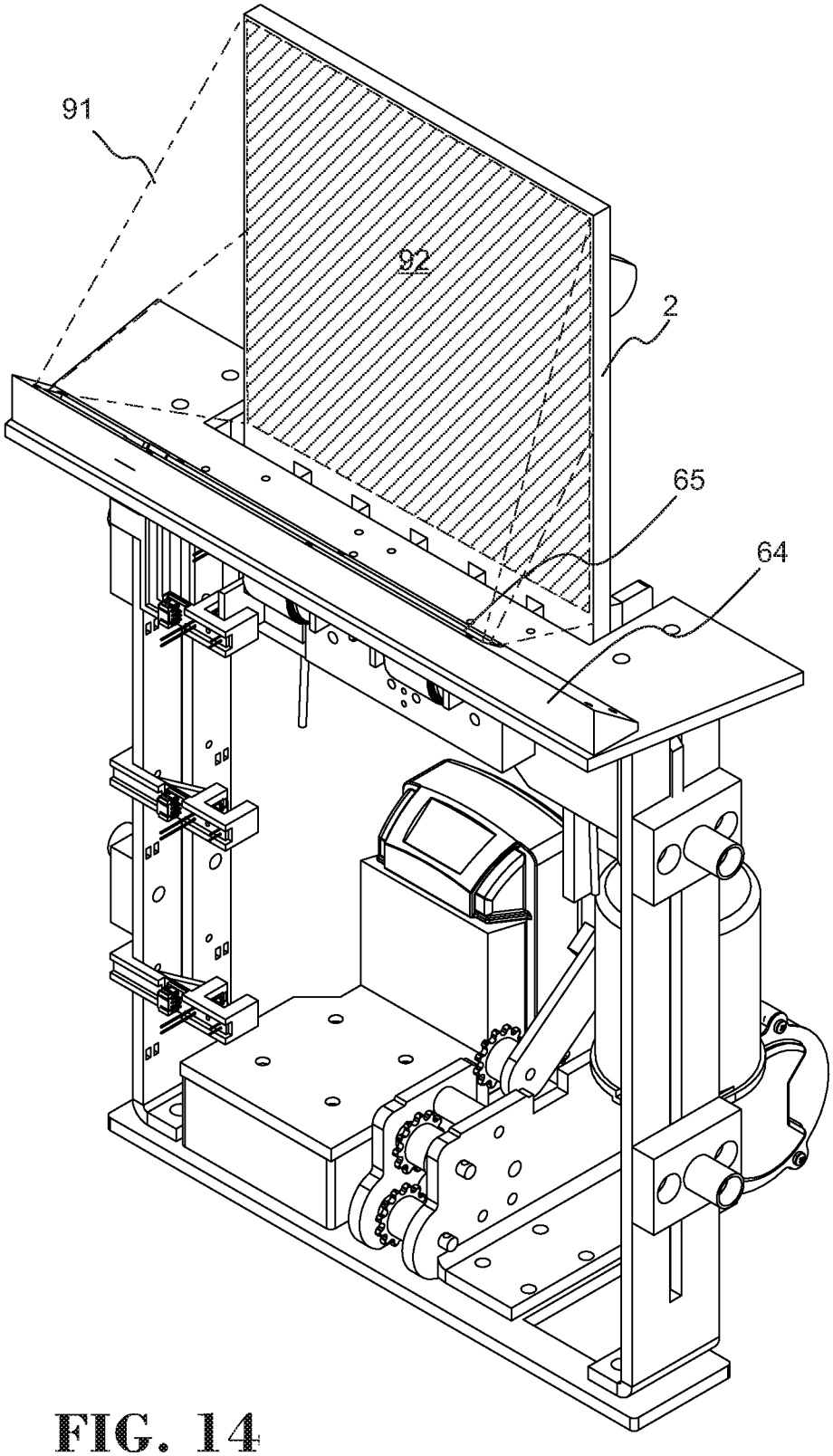
Figure 15A:
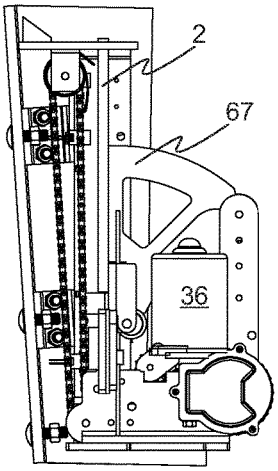
Figure 15B:
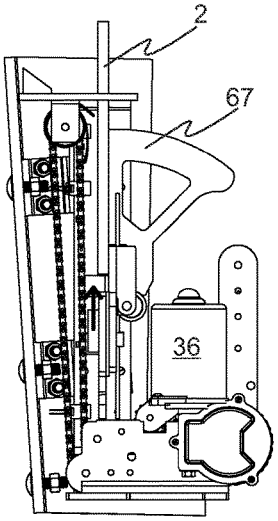
Figure 15C:
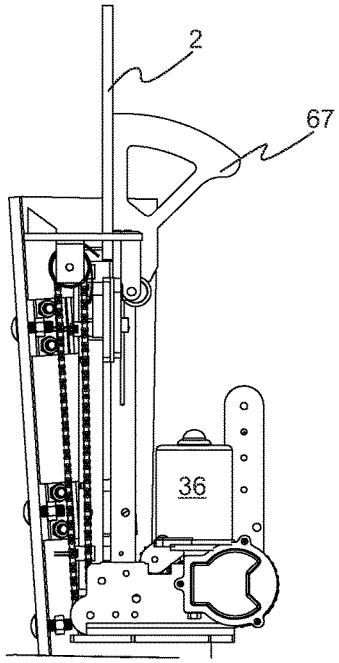
Figure 15D:
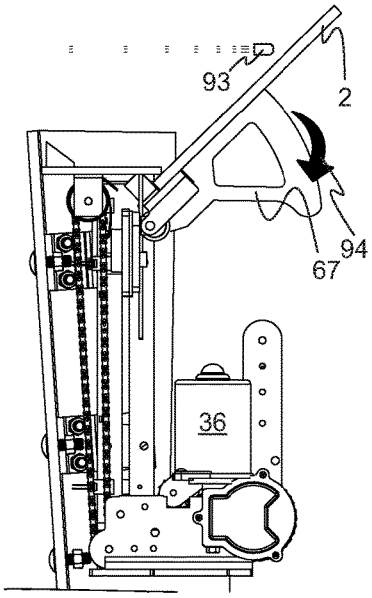
Figure 15E:
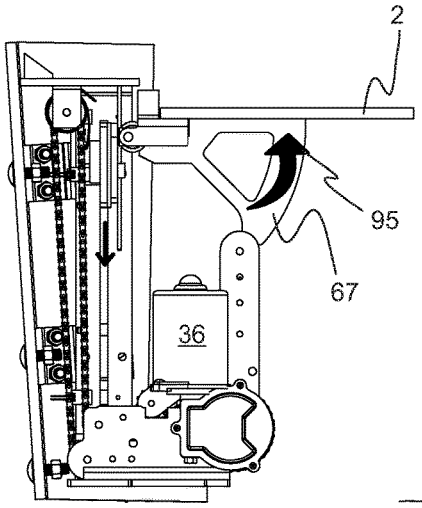
Figure 15F:
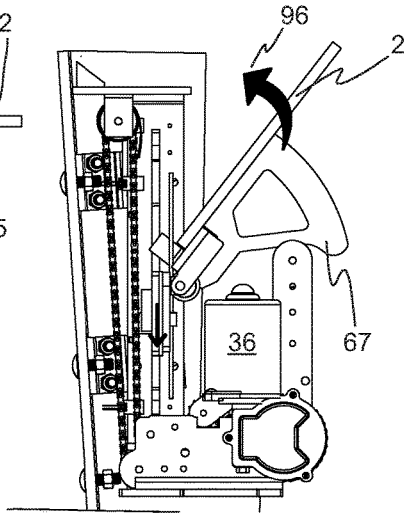

FIG. 14 shows the LED Illuminator operation and light path. When the Target Plate (2) is in the "up" position, the Illuminator Led Circuit Board (65), supported by the Illuminator Base (64), can light up the Target Plate (2), as shown by the Led Light Projection (91), within the Led Light Illuminating Target Plate Area (92). The Illuminator Base (64, FIG. 12), is protected by an Illuminator Clear Shield (66, FIG. 12) from shrapnel and debris.

FIGS. 15[A-F] depict a series of Transit States that the target goes through under typical operation. In 15[A], the Target Plate (2) is in the lowest position, and the Recovery Foot (67) holds it vertically against the Recovery Bushing (68, FIG. 10), preventing it from falling backward, and from moving vertically due to a locked Drive Motor (36). In 15[B], the Drive Motor (36) starts to elevate the Target Plate (2), and the Recovery Foot (67) can be seen now disengaged from being supported against the Recovery Bushing (68, FIG. 10), and it is continued to be lifted until it reaches the position shown in FIG. 15[C], where the Drive Motor (36) holds the elevation in position and stops moving.

If the program does not detect a "hit", after a scheduled time in the software, the sequence of 15[C], 15[B], and 15[A] is reversed, and the target resumes its starting position of 15[A].

If the user fires a Bullet (93) and hits the Target Plate (2), said Target Plate (2) begins to fall backward, as shown by the Arrow Showing Target Plate Falling Backward (94). The Recovery foot (67) aligns with the Recovery Bushing (68, FIG. 10), as it reaches the stage shown in FIG. 15[E]. At this point, the Drive motor (36) has not moved yet. FIG. 15[E] shows the recovery foot (67), impacting the Recovery Bushing (68, FIG. 10), stopping its rotation as shown by the Arrow Showing Target Plate Being Stopped By Recovery Mechanism (95). At this time, the Drive Motor (36) begins to lower the Target Plate (2), causing the Recovery Foot (67) to stand the target back up, as indicated by the Arrow Showing Target Plate Nearly Fully Recovered (96).

Figure 16:
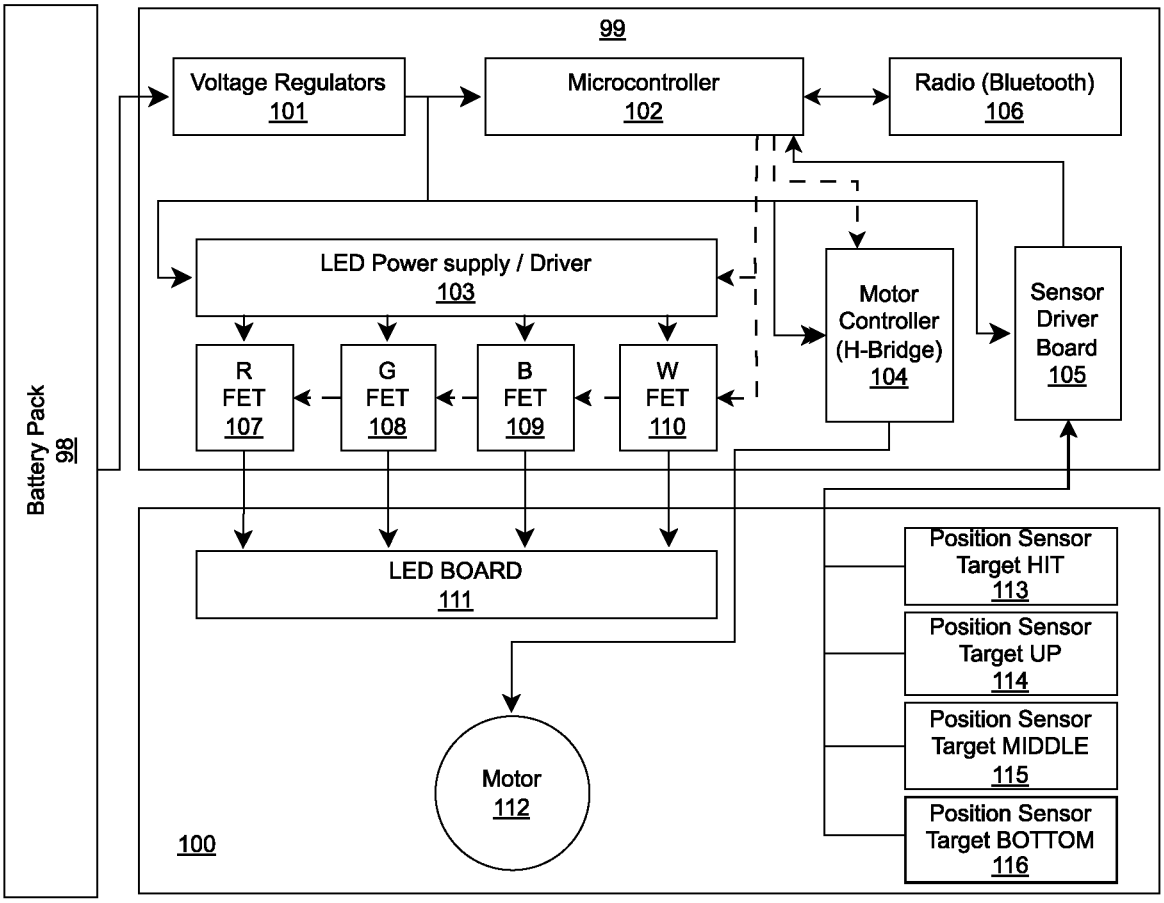

FIG. 16 shows a Embedded Circuit block diagram of the Embedded Computer Motherboard (10B). The circuit consists of three major sections: the Circuit Battery Pack (98), the Block Circuit Embedded Computer Controller (99), and the Block Circuit Frame Mounted Devices (100). Said Circuit Battery Pack (98) feeds power into the Voltage Regulators (101), which power the various major components of the circuitry. The Microcontroller (102) provides controls to the Led Power Supply/Driver (103), the Motor Controller H-Bridge (104), the Sensor Board Driver (105), and the Radio Circuit (106). The Led Power Supply/Driver (103) drives power transistors for each LED color through the Red Power Transistor (FET) (107), the Green Power Transistor (FET) (108), the Blue Power Transistor (FET) (109), and the White Power Transistor (FET) (110). These power transistors then drive the Led Board circuit (111). The Motor Controller H-Bridge (104) drives the Drive Motor (112). The Sensor Board Driver (105) reads the optical interrupt sensor states and sends the signals to said Microcontroller (102), from the Position Hit Sensor (113), the Position Up Sensor (114), the Position Middle Sensor (115), and the Position Bottom Sensor (116).

Figure 17:
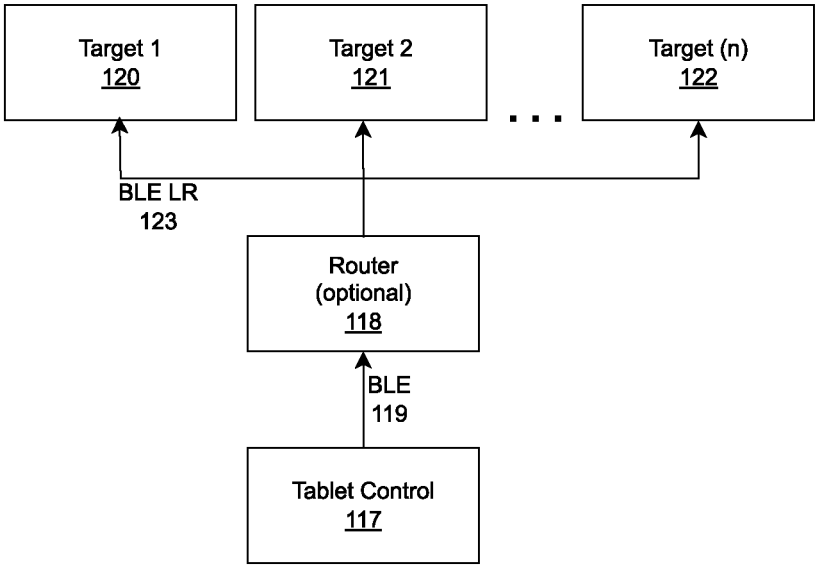

FIG. 17 shows a high level overview of the radio connectivity between the various components of the system. The user Tablet Controller (117) sends and receives Bluetooth. The Bluetooth signal is transmitted either directly to the targets (120, 121, and 122), or as the preferred embodiment depicts, through a Router (118) via a Bluetooth Signal (119). The Router relays said Bluetooth Signal (119) through Bluetooth Low Energy Long Range ("BLE") (123) to the individual targets, Target 1 (120), Target 2 (121), and any number of Additional Targets (122) provisioned in the controller application. Through this system, two way communication from the user's Tablet (117) to the Targets, and from the Targets to said user's Tablet is facilitated.

Figure 18:
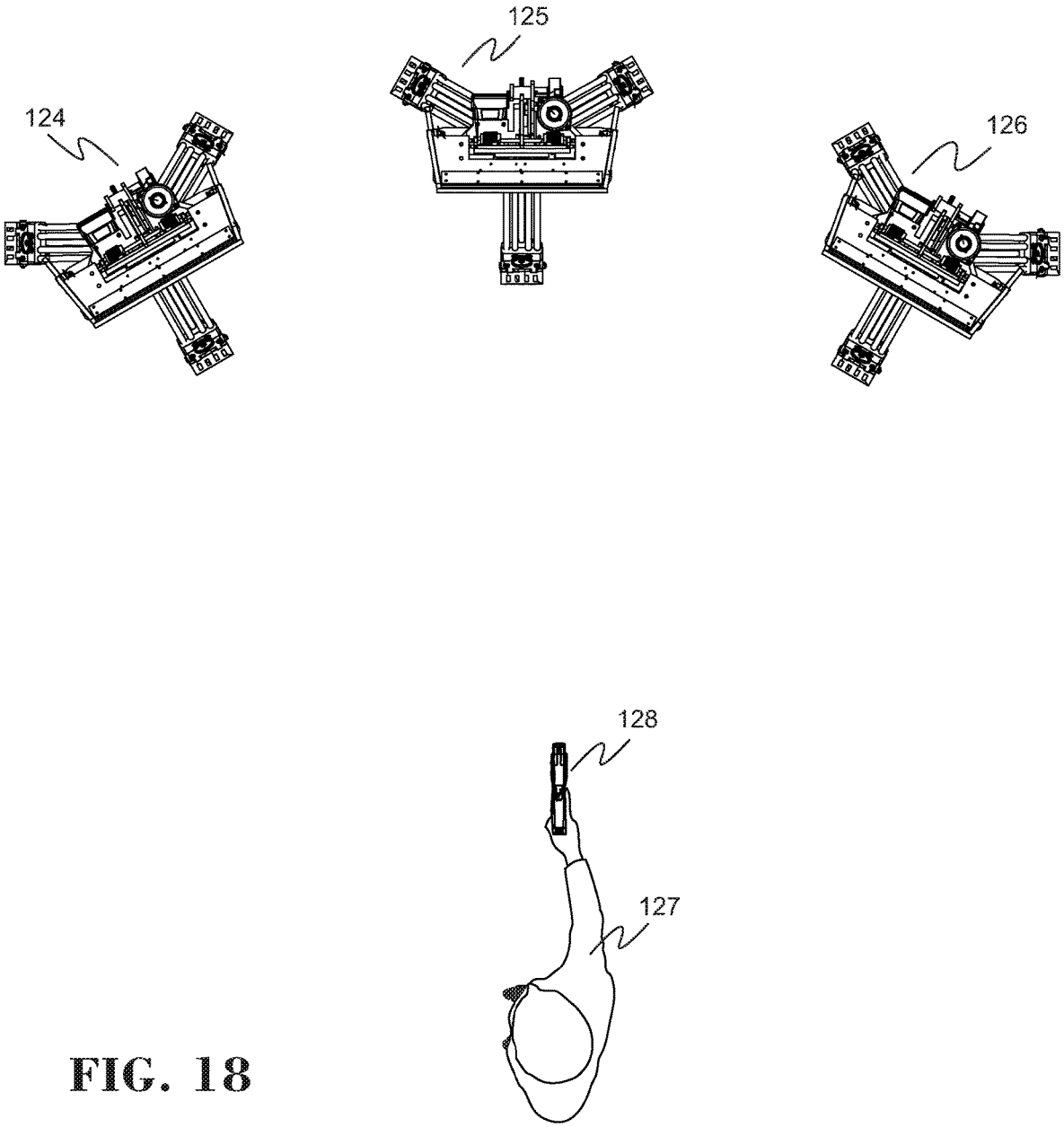

FIG. 18 shows an example Overview of a 3 target stage. The Shooter (127) uses a Firearm (128) to shoot at an arrangement of Targets. In this example, three targets (124, 125, and 126) are deployed on the shooting stage.

Figure 19:
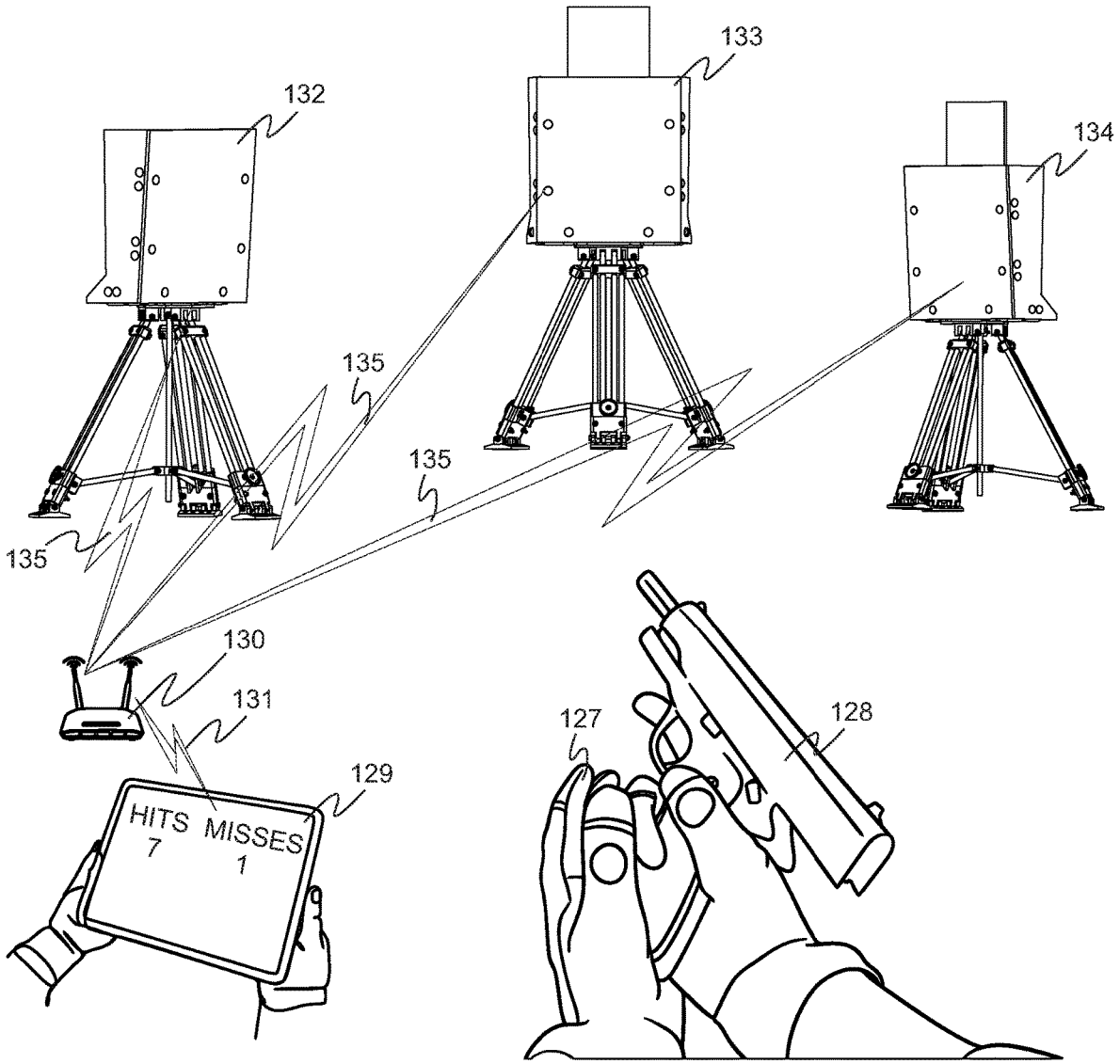

FIG. 19 shows a perspective "Point-of-View" representation of the shooting stage setup. The Shooter (127) uses a Firearm (128), to attempt to hit targets in accordance with a "drill" (schedule of events) as sent by the controller application, running on the Controller Tablet (129). Said Controller tablet (129) sends and receives the Bluetooth Signal (131) to a Bluetooth to BLE LR ("Bluetooth Low Energy Long Range") Router (130). Said Router (130) then sends and receives BLE LR Signals (135) to the various targets (132, 133, and 134). In the setup depicted, Target 2 (133) and Target 3 (134) are in the "up" position, while Target 1 (132) is in the "down" position.

Figure 20:
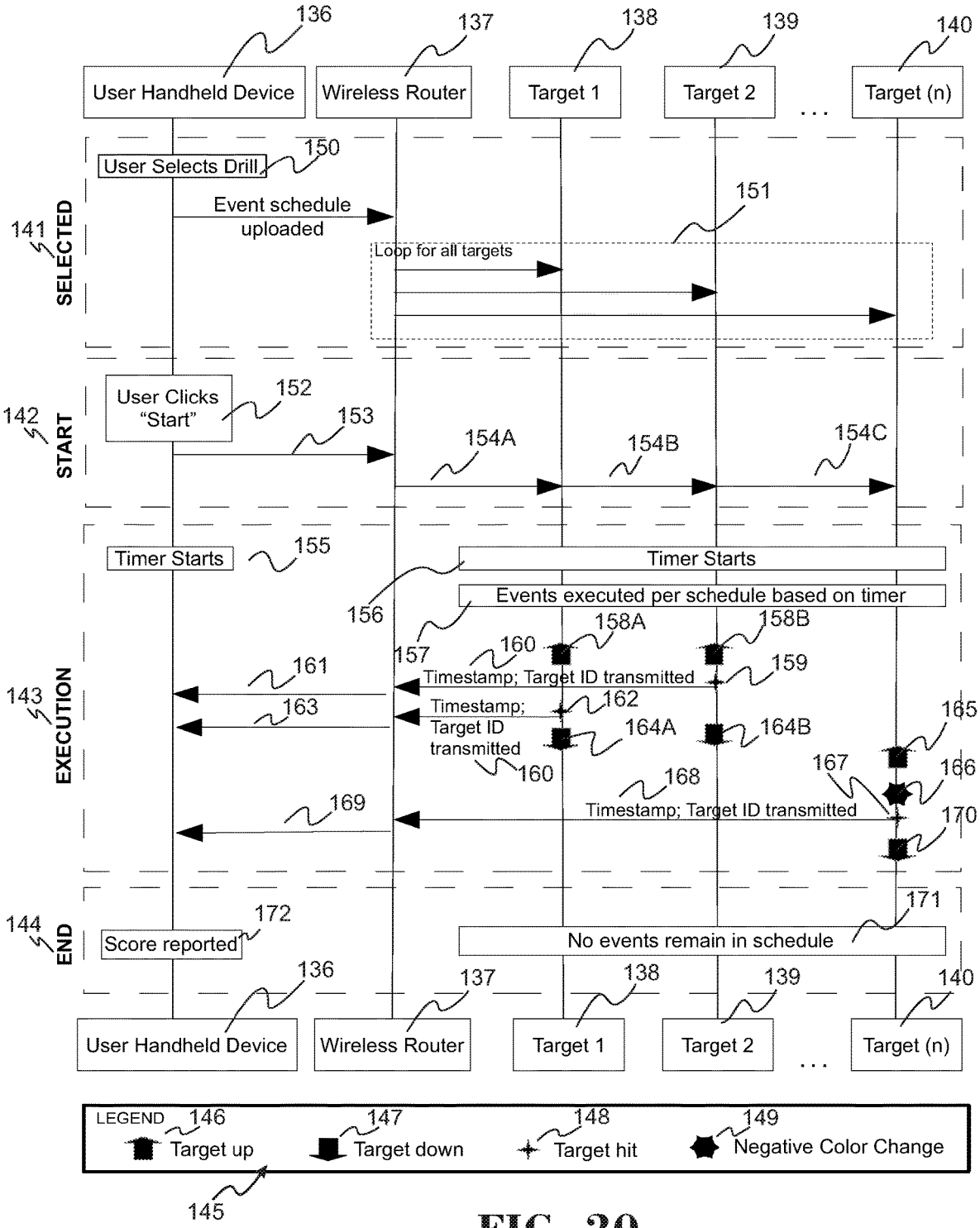

FIG. 20 shows a sample drill. This drill (schedule of events) is executed to run by the DART System. Time is represented vertically, from top to bottom, on the event diagram. The major components of the system can be seen in the swim lanes from left to right, labeled: User Handheld Device (136), Wireless Router (137), Target 1 (138), Target 2 (139), and Target (n) (140).

The major timeline events include: Selected Timeline Block (141), Start Timeline Block (142), Execution Timeline Block (143), and End Timeline Block (144). There is a Legend of Symbols (145) at the bottom to represent specific events efficiently in the diagram. These include the Target Up Symbol (146), Target Down Symbol (147), Target Hit Symbol (148), and Target Negative Color Change (149).

Drill Selected event (141): The timeline starts off by the User Selecting a Drill (150) from the control tablet. This triggers the event schedule for the drill, based on time elapsed from when the drill is started, to all the targets, shown as the Upload Schedule for All Drills to Targets (151) block.

Drill Started (142): When the user starts the drill, the User Clicks Start On Timeline (152) block is commenced, triggering a Start Signal to be Transmitted to the Router (153). The router retransmits the events to the targets in the system. In this example, the Start Signal is Transmitted to Target 1 (154A), Start Signal is Transmitted to Target 2 (154B), and Start Signal is Transmitted to Target (n) (154C).

Drill Execution (143): As the drill execution sequence starts (143), the Timer Starts on the User's Tablet Application (155), at the same time as the Timers Start on all the Targets (156). On each target (138, 139, 140), events are Executed per the uploaded drill Schedule (157). These events for this drill included: Target Goes Up on Target 1 (158A), Target Goes Up on Target 2 (158B), Target Sends "Hit" on Target 2 (159) as a BLE event. Transmission of: Target Id ("2") and Timestamp are Transmitted to the Router (160), the Router Relays Hit Signal to Application (161). In another transmission, the Target Sends "Hit" on Target 1 (162), and this in turn is related as a Hit Signal to Application (163). Target "1" Goes Down (164A), Target "2" Goes Down (164B), Target (n) goes Up (165), Target (N) has a Negative Color Change (166), Target (n) is Hit in a Negative State (167) causing Target (n) to transmit: Target Number (n) and Timestamp (168), to the Router that Relays a Hit Signal to Application (169). Target (n) Gets Down Signal per Timeline (170).

End event (144): For all Targets (138, 139, 140), there are No Remaining Events in the Targets Schedules Detected (171). The Application Timer at the same time Expires, and a Drill Scorecard Displayed (172) to the user on the user's tablet controller.

Figure 21:
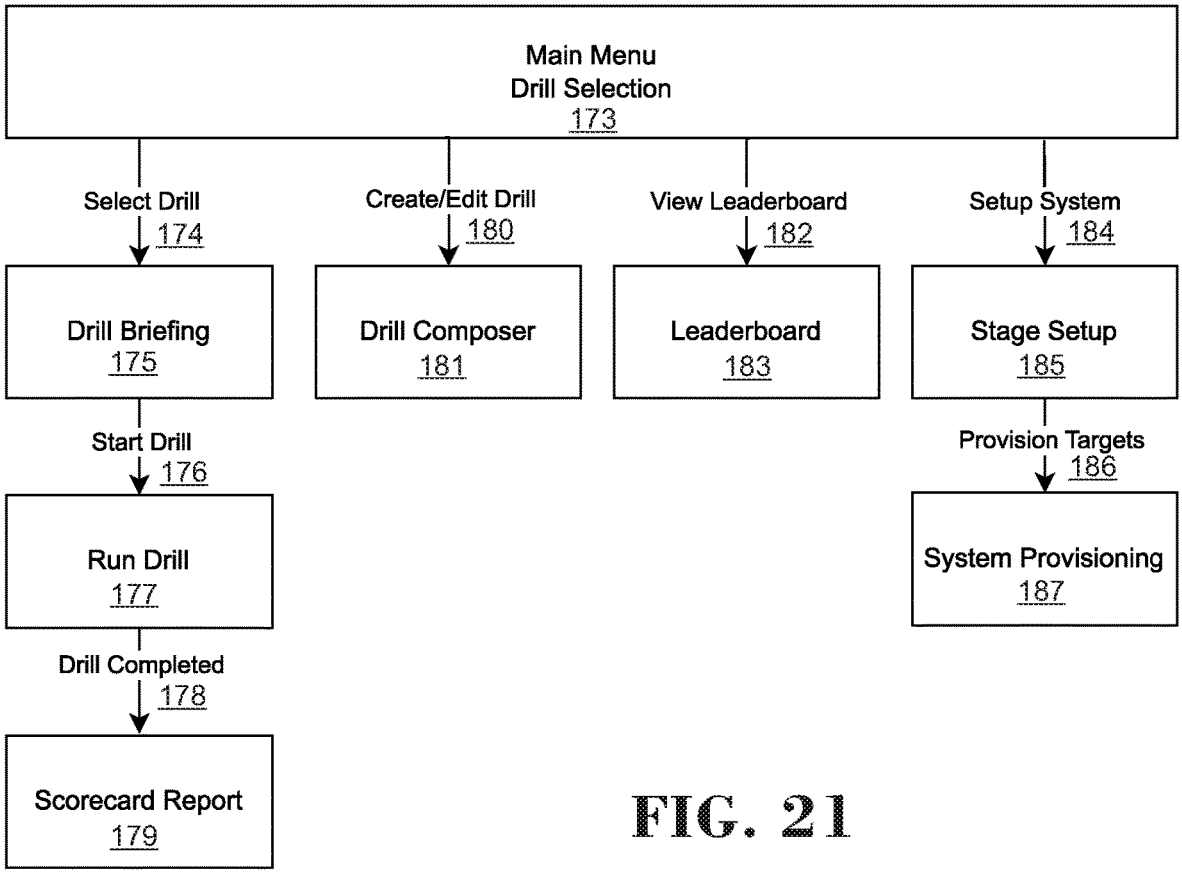

FIG. 21 shows the basic user's tablet software flow. The application starts on the Main Menu Screen (173). The user can Select Drills (174), triggering a Drill Briefing screen to be Displayed (175). If the user starts the drill (176), said application enters the Drill Run Routine screen (177). When the drill completes (178), there is a Drill Scorecard Displayed (179) to the user.

From the Main Menu (173), if the user selects "Create/Edit Drill" (180), they enter a Drill Composer (181) where they can edit and create new drills.

From said Main Menu (173), if the user Selects "View Leaderboard" (182), the Leaderboard Viewer is Started (183).

From said Main Menu (173), if the user Selects System Setup (184), they are presented with a Stage Setup function (185), and can Provision Targets (186), through the System Provisioning function (187).

Examples of each of these functions, mentioned in FIG. 21, are shown in FIGS. 22[A-H]. These are all part of the Tablet Software (188).

Figure 22A:
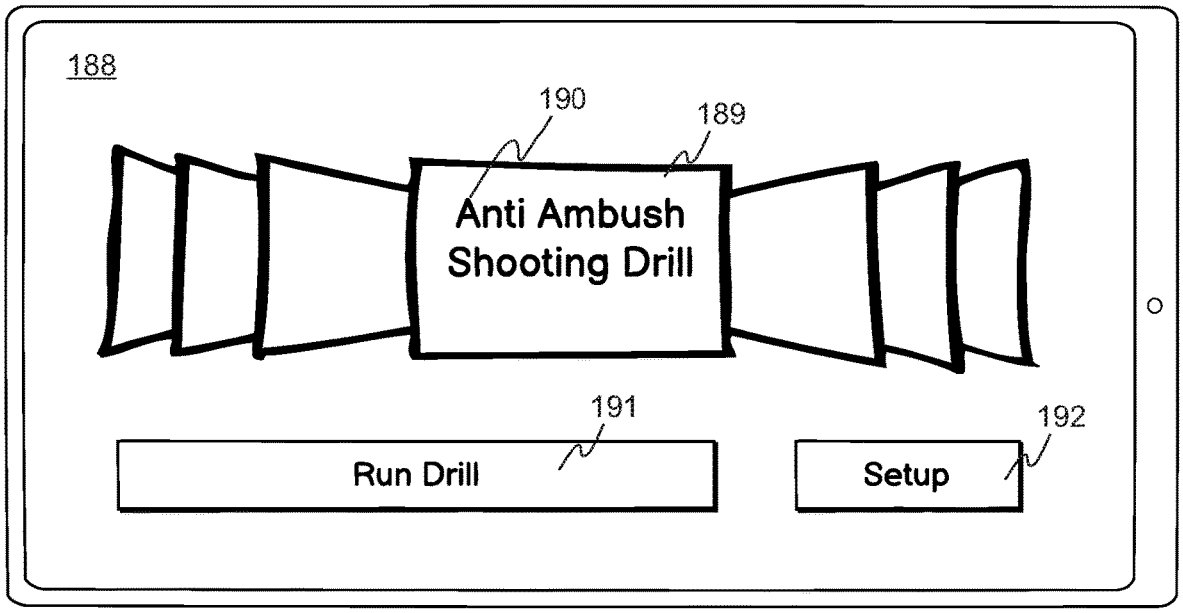

FIG. 22A shows the main user screen. There is a "Drill Carousel" (189), that displays Drills (190). There are also buttons for "Run Drill" (191), and "Setup" functions (192).

Figure 22B:
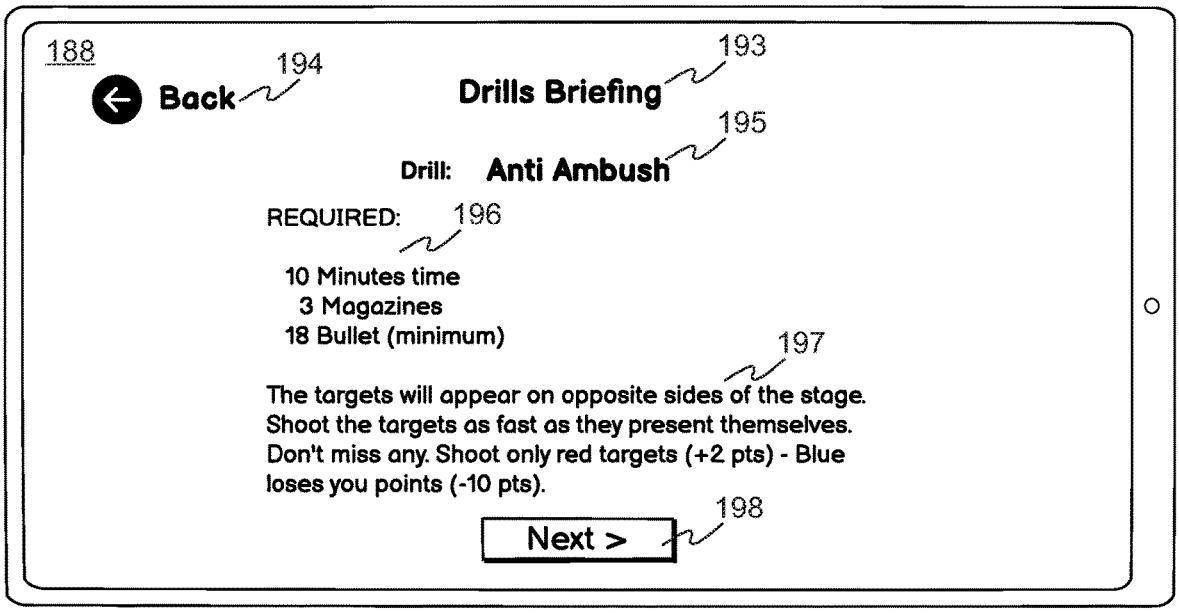

FIG. 22B shows a "Drills Briefing" function. Some basic software navigation such as a "Back" Button (194) and the Title of the Function (193). The Briefing screen shows the Drill Title Selected (195), Required Equipment, and Supplies for the drill (196), a Drill Briefing Text Field (197) to describe the drill, and a "Next" Button to Start Drill (198).

Figure 22C:
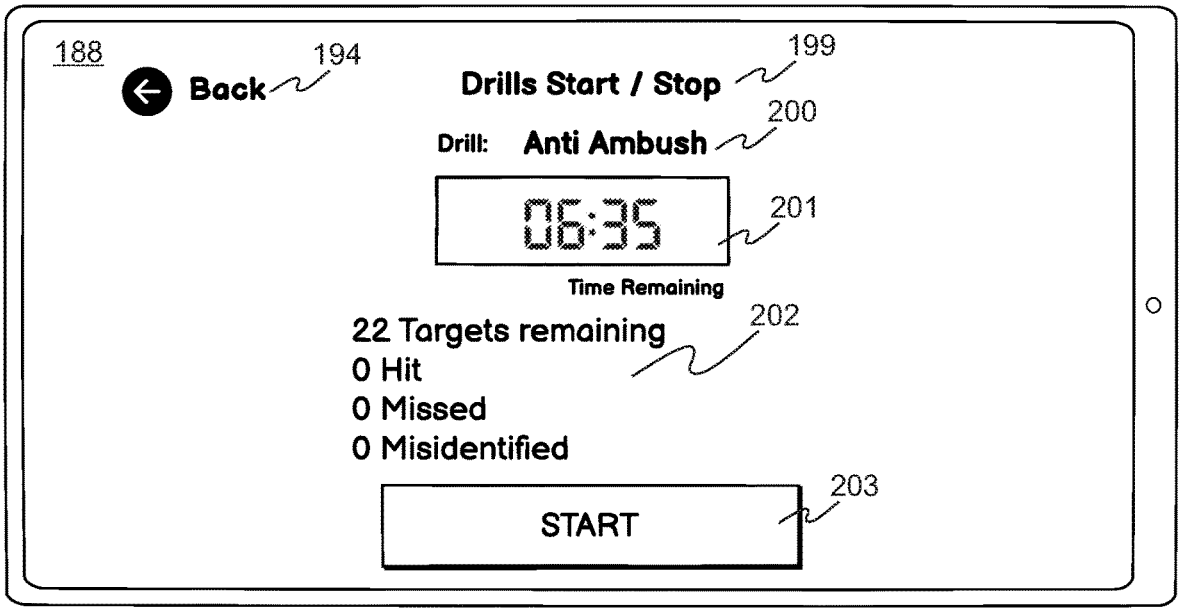

FIG. 22C shows the "Drills Start/Stop" screen. Basic navigation such as a "Back" button (194), the title of the function (199), the Drill Title selected (200), the Drill Time Remaining (201), some basic Drill Statistics (Real-Time) (202), and a "Drill Start" (/Stop) Button (203).

Figure 22D:
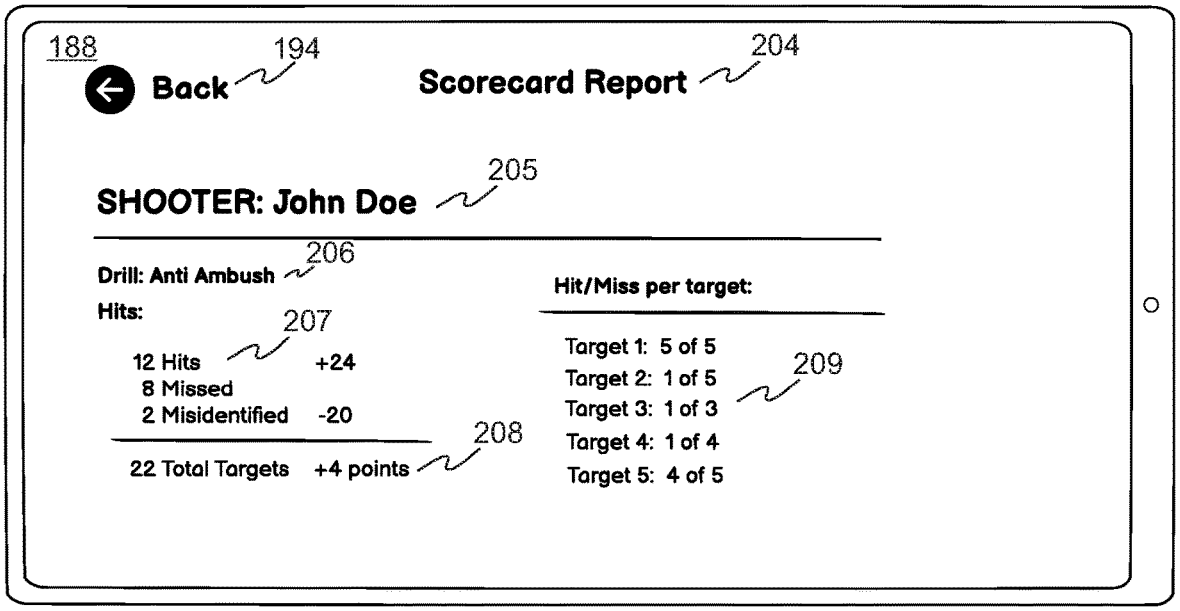

FIG. 22D shows the "Drill Scorecard." The title of the function "Scorecard Report" (204), and basic navigation such as the "Back" button (194) are displayed. In addition, the "Shooter('s)" Name Field (205), "Drill" Name of Scorecard (206), "Hits" Statistics for Scorecard (207), Totals of Hits/Misses/Points (208), and "Hit/Miss per Target" Modal Averages (209) are examples of fields that are applicable for most drills.

Figure 22E:
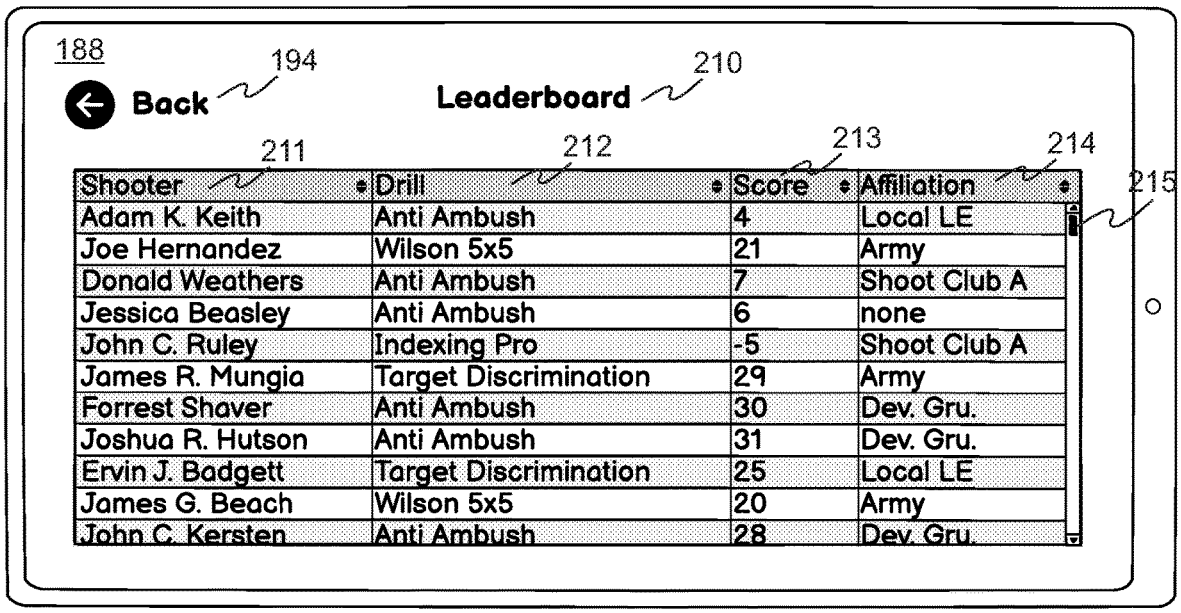

FIG. 22E shows a "System Leaderboard." The function contains basic navigation including a "Back" button (194), the Title of the module "Leaderboard" (210), and a number of database driven columns, including: "Shooter" (211), "Drill" (212), "Score" (213), and "Affiliation" (214). The Scrollbar (215) lets the user view lists longer than the screen can display at one time.

Figure 22F:
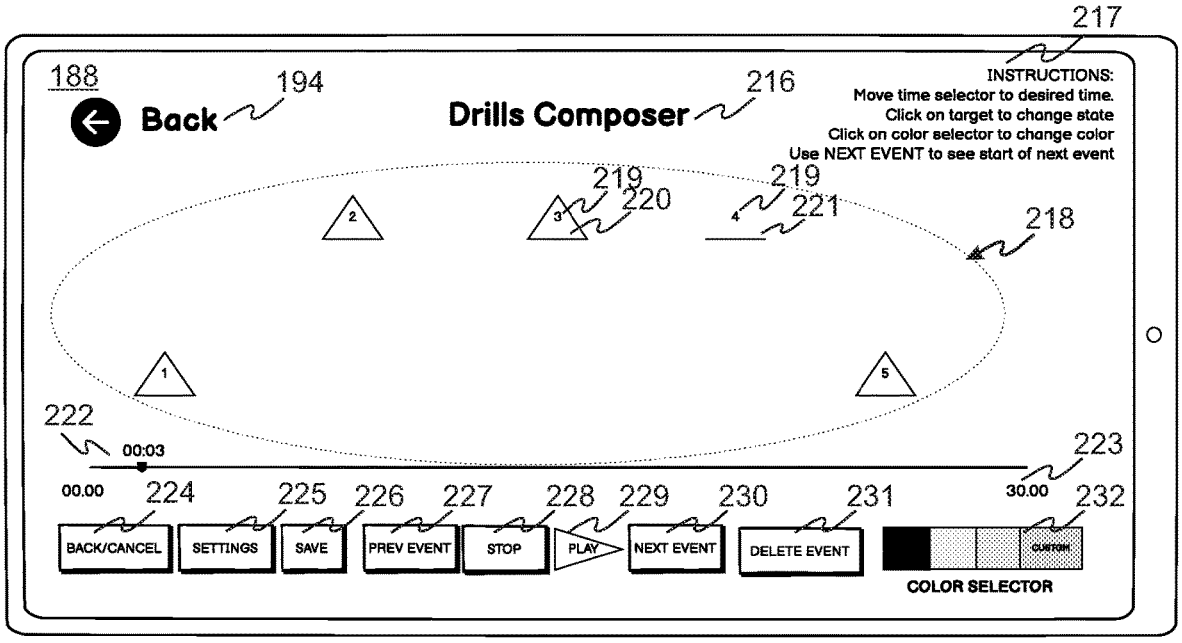

FIG. 22F depicts the "Drill Composer and Editor function." The basic module's navigation includes a "Back" button (194), and the Title of the module, "Drills Composer" (216), are displayed. There are Composer Instructions (217) to assist the user with how to use the functions. The center of the composer depicts a representation of the physical Target Arrangements on the shooting Stage (218). This includes the Target Number (219), a visual depiction of Targets in the Up Position (220), the various colors that the target plates can be illuminated, and the Targets in the Down Position (221).

For time navigation within the drill, there is a Timeline (222), an editable Drill Length Field (223), and a set of event buttons, to move forward or backward to the "Previous Event" Button (227), or "Next Event" Button (230) and a "Delete Event" Button (231). For target color illumination, there is a Color Selector for Led Illumination (232) where users select illumination colors. In the case of editing drills, the user can abort changes made via the "Back/Cancel" Button (224), or save the changes with the "Save" Button (226). Viewing the drill in real-time in accordance with the timeline clock, the drill can be evaluated with the "Stop" (228) and "Play" Buttons (229). Additional "Settings" (225) holds parameters that can be edited regarding the stage.

Figure 22G:
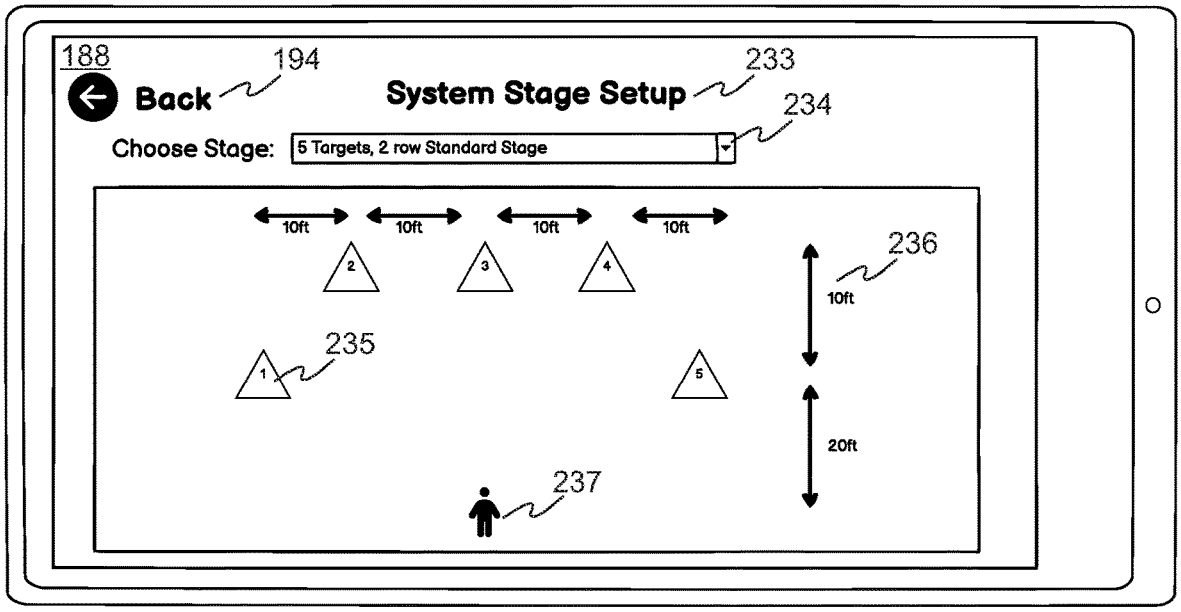

FIG. 22G depicts the "Stage Setup Screen". It has basic application navigation, including a "back" button (194), and the title of the module, "System Stage Setup" Title (233). It has a "Stage selector" dropdown (234) to view pre-defined stages or physical arrangements in 3-D space of how the targets are arranged, and the number of targets in the system, and how to set up the Target units (235). The Distance between targets indicators (236) and the suggested position of the shooter are shown via the Shooter icon (237).

Figure 22H:
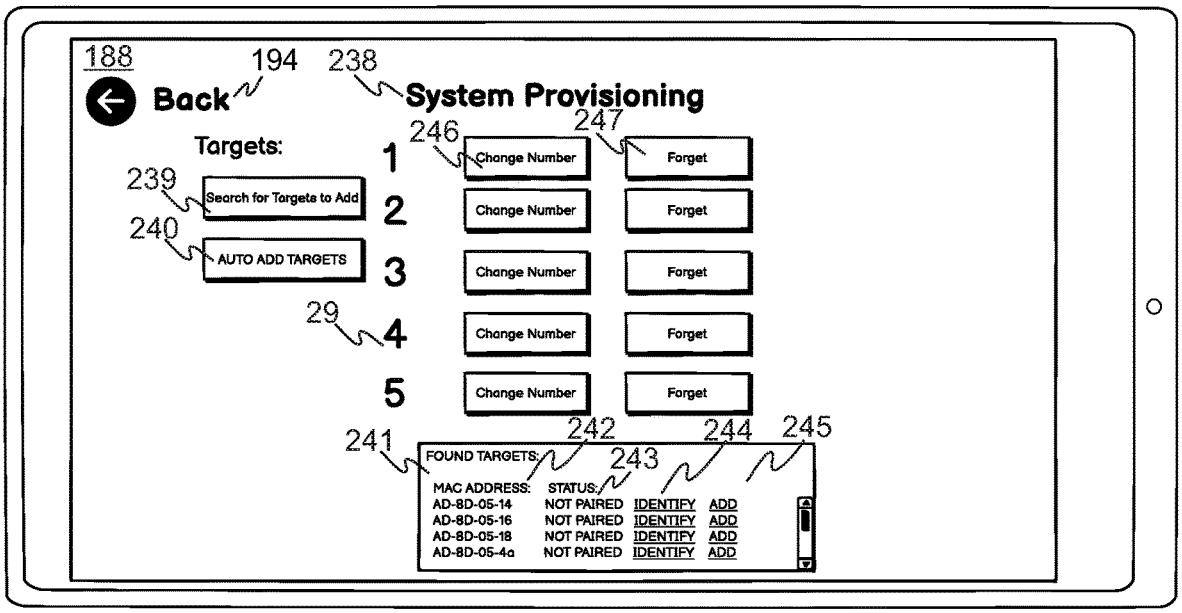

FIG. 22H shows the "System Provision" function. It has basic application navigation, including a "back" button (194), and the title of the module, "System Provisioning" (238). It has buttons for "Search for Targets to Add" button (239), and "Auto Add Targets" button (240). In the bottom of the screen, there is a "Targets Found" display (241) that shows the results from these functions. This includes the display of the MAC addresses ("Media Access Control Address") of Targets (242), Status of Targets (243), a clickable "Identify" link (244), and a clickable "Add" Target link (245). Once targets are added to the system, they can be rearranged using the "Change number" button (246), or removed via the "Forget" target button (247). This allows for targets already in the system to be reassigned different target identity numbers, or removed.

DETAILED DESCRIPTION OF THE INVENTION

Purpose of the System

The present invention describes a novel shooting range training system. The system's purpose is to provide dynamically presented targets to the shooter. The shooter engages and attempts to hit target plates that emerge from the targets with a projectile (bullet, paintball, pellet, or similar object). The gamification aspects of the system allow for unique skill sets to be acquired by the user through dynamic training, while capturing analytical data on the shooter's performance, and allowing the shooter to focus on improving specific skill sets.

Top-Level System Architecture

The overall system consists of one or more targets that are arranged in a shooting range area, termed a "shooting stage." These targets are mounted to stands, at adjustable heights. The user's objective is to shoot target plates concealed in said target units behind each target's shield assembly as they rise above the shields ("present" themselves). Said shield assembly provides a protective "bunker" for the target plate. Through the use of a wirelessly connected controller computer (the preferred embodiment uses a tablet computer), the targets can be controlled directly (manually), or through uploading and executing of a schedule of events (termed a "drill"). The controller computer loads said drill from its filesystem, and sends the drill events pertinent to each target to the various targets. All the targets are given a start command at the same time, wirelessly. Events for each target are executed based on the drill schedule, and the time elapsed from the starting time of the drill. As drill events occur, target plates are caused to move up, down, reset their position from a fallen backward position when hit, and change colors. When target events occur, such as "hits" to the targets, each target transmits the relative time that the events occurred to the controller computer. Detailed metrics can be calculated and displayed in a plethora of different manners from these events based on scoring rules for each drill.

The Tablet and App

A controller computer tablet, running an application ("app"), allows the user to control the targets, either manually or through a pre-programmed schedule, termed a "drill." The app contains a library of training drills that can be selected by the user and sent to the targets, or loaded from an on-line library of downloadable drills. The app takes data received from the targets during the drill's run time and converts it into statistics for display on a leaderboard, in a report, or for tracking the user's training progress historically over time.

The app provisions target nodes, selects drills, sends schedules to the targets, shows setups of the targets, and maps these to a "stage" diagram. It can optionally use AoA ("Angle of Arrival") and AoD ("Angle of Departure") 2D and 3D radio positioning to aid in layout of targets. The app records drill results, displays reports, and sends start and emergency stop commands to all targets. It also supports the composition of new drills through a "drill composer," or state based composer module in the app. "Competition mode" (red team/blue team) can allow for time/accuracy trials, and competitive shooting competitions to be performed. The app also provides options to purchase and download new drills, as well as training sets, or collections of drills with instruction from celebrity shooters and trainers to be downloaded and used.

Tablet Connectivity

Each target contains an embedded computer. Said embedded computer is linked wireless to a controller app. The controller app is used to send the drill to the targets, coordinate a start time, and track metrics from target events. These target events include a user hitting a target successfully, the elapsed time between the presentation of the target and the time it took them to hit the target, or when the user fails to hit a target in the allotted time before the target plate lowers and resets. An optional router can be used to translate Bluetooth signals to Bluetooth Low Energy ("BLE") Long Range ("LR") to aid in further range and allow for tablet devices not supporting BLE LR protocols to utilize the extended range of the BLE LR signal. In the preferred embodiment, both Bluetooth and BLE LR are utilized, however other radio protocols and frequencies could be employed, including LoRa (Long Range), Wi-Fi, Long Range Wi-Fi, and other wireless methods of communication.

The Targets

The presentation times of the target plates is controlled via the drills sent from the app. The target plate presentation is time-limited, exposing the target plates for only a finite duration, allowing for a limited window of opportunity for the target to be hit. The targets can be presented one-at-a-time or coordinated, presenting multiple simultaneous targets at the same time depending.

Targets are illuminated by LEDs positioned just under the target plate, allowing for the targets to be "painted in various colors" by the LED panel, in varying intensities. These color patterns are integrated into the training plan of the drill, and affect the values displayed in the metrics, or manually activated by the manual mode of the controlling computer interface. The preferred embodiment utilizes the basic visible colors of red, green, blue, and white. In addition, infrared LEDs, for night ocular device training, can also be added as additional color channels, or substituted of any of the color LEDs shown. Through combining different colors and intensities, many different colors can be generated.

A heating element positioned on the back of the target place allows for thermal scopes and vision systems to be implemented into the training programs.

Target Mechanics

The target plate starts at the bottom position, fully concealed by the front shields. When the embedded computer control module triggers the linear actuator, the target plate raises to the top position rapidly. It can optionally be "painted" in light a specific color and change at any time during the drill, as controlled by either the manual app functionality or the drills. The linear actuator is depicted as the "elevator" mechanism, consisting of a simple chain-driven hoist powered by a fast and powerful motor. The target plate is affixed to the top of the actuator on a pivot or hinge. When the target plate is in the "top most" position, it is balanced so that it stays erect, but shall fall backward easily when hit by a bullet, pushing it past the balancing point. Other mechanisms to allow for targets to be positioned at angles, sideways, and even inverted could also be used, however the preferred embodiment shows a simple and effective mechanism that works reliably in the vertical position.

Target plate consists of a plate of a durable material capable of receiving impact from repeated gunfire while sustaining minimal damage. Commonly this would be AR500 steel (abrasion resistance steel typically with a hardness of 477-534 Brinell Hardness Number), or a similar durable material that resists damage from bullet impacts.

The target shield assembly, the heaviest part of the individual targets, is designed for easy and quick removal of the electromechanical mechanisms from the shield receiver slots, allowing for the shield assembly to remain mounted to the stand. This design ensures that the delicate, expensive, and critical components can be rapidly protected from inclement weather, theft, and damage. This also allows for the handling of lighter components during field deployment.

Target Hit Detection

When the target is hit, it shall fall backward, triggering the "Hit" sensor. The preferred embodiment utilizes an optical interrupt and optical interrupt tabs to block the interrupt optical path. Alternatively, a hall effect, contact switch, rotational encoder on the drive train, or tilt switch for detecting the target falling backward could also be used. Once triggered, the sensor sends an electrical signal to the target's microcontroller. The target plate is retracted by reversing the linear actuator, returning to its standing vertical position through mechanical means as the elevator mechanism moves downward. The target plate moves downward until the Down position sensor optical interrupt is triggered, sending an electrical signal to the microcontroller to stop the motor. Based on the design of the recovery assembly, the target plate is returned to its vertical starting position, regardless of whether the target plate has been hit and is laying backward, or not hit, and is still in the vertical position.

Target Speed Control

Speed control of the target plate mechanism is accomplished by decreasing the power to the motor, by increasing the Pulse Width Modulation (PWM) of the motor controller. This allows for the motor to start to slow the elevator mechanism and target plate prior to reaching its destination. Speed control feedback is accomplished in the preferred embodiment by calculating the time elapsed between optical interrupt sensors. Middle position of a moving elevator mechanism is important to allow for the motor to be slowed prior to being stopped to prevent abrupt and potentially damaging stops. Position and speed feedback could also be accomplished by an encoder on the motor shaft, drive train, or a hall effect sensor monitoring the motor shaft's rotational position.

Electrical Components

Each target contains an embedded computer that includes a microcontroller, position sensor inputs, a motor control circuit (H-Bridge), LED driver to illuminate the target plate, a radio and antenna circuit to communicate with the user's router and tablet, and power regulation circuitry. The sensor inputs are optical interrupts consisting of an infrared LED and phototransistor sensor. The linear actuator motor and sensors (top, middle, bottom, and hit) are connected to a microcontroller, which makes the linear actuator raise or lower the target by reversing the motor's polarity through the motor controller. The preferred embodiment depicts an H-Bridge, but a relay or other power control circuit could also be utilized. An LED driver connected to the microcontroller controls the LED array. This array typically includes red, green, blue, and white color channels, however may also include infrared (IR) light channel elements. In addition, an optional thermal heater can create a hotspot in the center of the target through the use of a heating element placed in the center of the target plate, and connected to a switching transistor on the motherboard.

Microcontroller Software

The microcontroller software is responsible for the individual target operations. It handles receiving and sending events to the tablet via RF over Bluetooth, specifically BLE LR. It receives drills in the form of schedules of events triggered from the elapsed time after the app sends a "start command" to the targets. These events include moving the target up, target down, resetting the target position, controlling the target speeds, and "painting" the target with light in various colors. The firmware senses, timestamps, and transmits telemetry events, such as registering hits of the target plate, to the app in near real-time and as a log of time and events stored internally.

Differentiators

This shooting range training system stands out due to several key differentiators. Unlike many firearm and shooting training systems, it uses real firearms, providing users with authentic tactical feedback. The system's portability is a significant advantage; it is deployable in the field, rearrangeable, and quick to set up with non-permanent fixtures, unlike permanent ranges. The system is weight compensated with multiple springs, to allow for minimal energy consumption on moving the target plate mechanisms. The system has colored LEDs, optional IR LEDs, and an optional thermal heater—this allows for target discrimination skill honing. It supports a wide range of drill skill metrics, games, and skills training. Metrics gathered from the target app can be aggregated into specific shooting skills, competition shooting, reporting and compliance, and recreational shooting, offering a comprehensive and versatile training experience. The gamification, metrics based analytics, and versatility of operational modes makes this system highly unique for training shooters over a wide range of skills. These features collectively make it a superior choice for realistic, flexible, and comprehensive shooting practice.

Application Overview

The system architecture includes the tablet and app, an optional router, and one or more targets. The app and tablet coordinate the start and operation of the drills, while the router extends connectivity range. Targets receive schedules, start in unison, and perform actions as programmed, with metrics tracked and reported by the app. The system allows for the rapid deployment, rearrangement of the position of the targets, integration with existing and dedicated firearm ranges, and disassembly of the system.

Drill Skill Metrics, Games, and Skills Training:

Metrics gathered from the target app can be aggregated into five major groups.

These include:

a) Training specific skill sets;

b) Competition shooting;

c) Reporting and compliance;

d) Recreational shooting; and e) Additional training modes and methods.

a) Training of Specific Skill Sets:

Drills can be created to focus on specific skill sets. These drills can be used to evaluate a shooter's current skills and those in need of improvement, as well as capture metrics designed to show shooter skill progress over time. Examples of skill sets that may be incorporated into drills include:

Target discrimination—to improve shooter training against the misidentification of unintended target fire, a colored light system is incorporated into the target. This light system colors each target plate with a color as directed by the drill running on the app. Score values can be assigned to specific colors to signify giving the user points or subtracting points from their score and metrics. For example, a red target can signify an engageable target that rewards the shooter with +5 points, a blue target signifying a "do not fire upon" state that would cost the user −3 points if hit, and a yellow target that indicates that it is about to turn either red or blue, and carries no points if hit.

Target indexing—targets sequentially present themselves, one at a time, forcing the user to have to pivot and index to the next target to engage it.

Split field shooting—a training drill that forces the user to have to split their attention between the far left and right of targets on a stage, either in rapid succession or at the same time, simulating a real world ambush type attack.

Rabbits—rapidly rising and falling targets, that sweep from one extreme end of the target row on the stage, to the other, simulating Rabbit Clay shooting.

Drawing and target acquisition speed drills—diminishing or decaying score values for hitting an engageable target over the presentation time of the target plate. In this case, targets scores decay from the time that they are presented, until they are retraced. Shooting a target sooner upon it appearing from behind the shield assembly makes it count for more points than shooting the target plate closer to when it is ready to retract for not being hit.

Distributed field—having a stage with bases where the user must move from base to base, each time taking a predetermined number of shots before progressing the next stage.

Low light and IR illuminated targets—special forces rely on Night Ocular Devices ("NODs") to better see in low light conditions. These devices are sensitive to infrared light. Through utilizing IR illumination, or extremely low visible light settings, in a dark environment or nighttime setting shooting range, familiarity with their weapon and shooting tactics can be optimized.

Thermal IR target shooting—mid to long range shooting often incorporates the use of thermal scopes to identify targets. Through the use of a heating element on the target plate, better use of thermal scopes can be gained in training.

b) Competitive Shooting

Competitive shooting is a sport that demands precision, speed, and accuracy. Participants are required to hit targets at varying distances and from different positions, all under strictly controlled conditions to ensure fairness and consistency for all competitors. Typically, shooters navigate through courses that feature multiple targets set up in diverse scenarios, with a strong emphasis on quick target acquisition and precise shooting.

The DART system introduces innovative elements to competitive shooting, significantly enhancing the challenge and enjoyment of the sport. One of the standout features of the DART system is its ability to display targets in different colors, which indicate positive and negative scores. This feature adds an engaging layer of strategy to the sport, incorporating go/no-go target engagements and competitive teaming strategies. For instance, in a go/no-go target engagement drill, shooters might be instructed to only engage targets illuminated in red and to avoid those in blue. Engaging the incorrect color results in a penalty, adding a tactical decision-making element to the drill.

Additionally, the DART system incorporates speed control to precisely regulate the speed of target presentation. It uses embedded sensors in the targets to measure the time it takes for a target plate to move from the bottom sensor to the top sensor. This data is then processed by a machine-learning algorithm (rolling average), which is used to adjust the output current from the motor drive circuit (H-Bridge). This ensures consistent movement of the targets, even accounting for factors like mechanical wear, battery voltage changes, and other variables, thus maintaining reliable and uniform operation.

The high accuracy and repeatability of the DART system allow competitors to participate in events at different shooting ranges or even across diverse geographic locations, whether in regional or global competitions. This is facilitated by the integration of tablet software applications that connect over the internet, enabling shooters to compete against each other no matter their location. This connectivity not only broadens access to the sport but also standardizes competitive experiences globally, making competitive shooting more accessible and uniformly regulated.

This capability for networked competition can cultivate a social media following and facilitate the creation of engaging content, such as monthly, weekly, and daily challenges—for example, the "Drill of the Day." This feature adds a dynamic and interactive dimension to the sport, encouraging ongoing participation and community engagement.

c) Reporting and Compliance

The DART system offers precise and quantitative metrics that assess a shooter's abilities and skills. This system is particularly beneficial for standardized testing and qualification processes within police and military organizations, enabling the quick and accurate demonstration, documentation, and classification of proficiency in specific skill sets. For instance, the Municipal Police Officers Education and Training Commission (MPOETC) specifies requirements for police firearms qualifications, while the US Army utilizes forms such as DA 3595-R and DA Form 88-R to record and evaluate a soldier's firearm proficiency and combat pistol qualifications, respectively.

Standardized drills could be designed to align with these qualifications. Individuals undergoing evaluation could perform these drills, and their performance would be analytically assessed across various skill sets. The resulting metrics could then be compiled into reports automatically forwarded to relevant parties such as a Master of Arms or a Chief.

Such reports ensure that minimum qualifications are precisely recorded. In a military context, this enables Masters of Arms to quickly assess the specific readiness and skill sets of their teams. From a law enforcement perspective, it certifies that officers not only meet minimum qualifications but also facilitates comparative evaluations against other departments. This could potentially lead to insurance premium discounts for departments demonstrating higher training levels and superior skill scores.

d) Recreational Shooting

Recreational shooting caters to individuals who engage in the activity for enjoyment rather than professional advancement, skill optimization, competitive purposes, or qualification under specific standards often related to employment. Recreational shooters, typically members of the general public, may use systems that offer an experience akin to real-world versions of video games like "Duck Hunt" or "Whac-A-Mole." This form of shooting serves as an appealing alternative to traditional paper targets at ranges, offering participants a more immersive and exhilarating experience.

Less lethal guns can also be used with the described system instead of traditional "bullets." In this use case, the targets would be built most likely of lighter materials, such as plastic, instead of bullet resistant steel. The guns would instead shoot plastic Airsoft pellets, paint filled gelatin or polymer balls such as Paintballs, and even foam Nerf darts and balls in order to hit the target plate and score on the application software. All other aspects of the system would function identically. This would also allow for the system to be used in regions where traditional firearms might not be allowed or desired.

e) Additional Training Modes and Methods

There are countless arrangements and stage setups that can be devised through using these wireless dynamic automated targets. Briefly touching upon some of the more interesting shooting arrangements would include:

Stage progression—having a stage or course where the shooter is must move across the stage, stopping at a number of bases. On each base, the user is limited on the number of shots they are allowed to take. Each base would present a different visual perspective of targets that they have to "clear" or shoot.

Underwater target ranges—the targets can be made water resistant (IP68 or similar in standard). This would allow for the complete concealment of the targets, under for example, a lake or protected area of ocean. The shooters would gain experience in how to respond to environments more typical of seamen or Navy personnel.

Sideways and angled operation—through varying the spring return mechanism, targets can be made to present themselves at various angles, besides just straight up and down. For example, presenting themselves from a sideways, or even downward (upside down) position.

Shot detector—through implementing a shot detector in the app, utilizing the tablet's microphone and an algorithm to match the approximate "fingerprint" of a close gunshot being fired, users can receive feedback on the number of shots they have fired, versus the number of targets and timing windows of each target's presentation. Without a shot detector, only targets presented and not hit, versus targets presented and hit can be ascertained.

Long Range ("LR") and Extreme Long Range ("ELR")—utilizing the exceptional transmission distance of the wireless protocols, combined with optional mesh network arrangements, targets can be positioned at great distances. This type of arrangement can aid in training for sniper and long range infantry skills.

Conclusion

The novel shooting training system described herein provides a significant improvement over previous training systems. The system offers a versatile training environment, enabling the enhancement of skill sets that would otherwise be difficult, if not impossible, to improve upon using prior methods. Its metrics-driven approach allows users to monitor their progress over time and evaluate their performance relative to their peers. The high portability and rapid deployment capabilities of the system make it ideal for both permanent and temporary training setups, offering unparalleled flexibility and convenience for diverse training scenarios.

The invention claimed is:

1. A reactive shooting training system comprising:

a. one or more electromechanical targets;

b. a central controller computer;

c. an application that runs on said controller computer configured to manage target operations and training drills; and d. training drill programs executable by said application to control target presentation and record performance metrics, wherein the electromechanical targets include a linear actuator for raising and retracting the target plate in a straight line from bottom to top of the target, operable independent of hits, with each target further comprising:

a. a shield assembly to:

i. protect a target plate from being hit; and ii. protect delicate mechanisms and electronics, b. a target plate that a shooter attempts to shoot at and hit;

c. an embedded computer to control the target function; and d. a linear motorized system to move the target plate up and down, wherein the electromechanical targets include a mechanism for varying the target plate's color using multi-colored LEDs in the visible and infrared spectrums, enabling target discrimination training and specialized drills.

2. The system, as described in claim 1, wherein the controller computer is configured to integrate the target's embedded computers into the application's setup, enabling said targets to be individually addressable and centrally managed by the controller computer, ensuring drill-defined positioning corresponds accurately to physical target positions, relative to the shooter: including mapping training drill defined positions on the controller computer to physical locations on the shooting range where the targets are positioned.

3. The system, as described in claim 2, wherein the controller computer communicates with the individual target's embedded computers, by:

a. sending commands to:

i. control the starting of timer clocks on all targets to synchronize with the application's clock;

ii. upload schedules for each target of time-based events, known as drills, which execute in a synchronized fashion among the targets based on the elapsed time since the elapsed time from when the timer clocks were started;

b. receiving data from the targets, including:

i. target plate hit detection events;

ii. system status events such as battery power remaining;

c. issuing manual commands to immediately activate various functions on individual targets, including:

i. changing the color or brightness of the LED lights on the target plate;

ii. motion commands to raise and lower the target plate.

4. The system, as described in claim 1, further comprising:

a. a mechanical method that allows for said target plate to be raised linearly upward from behind a shield;

b. a mechanical mechanism that allows for said target plate to fall backward, rotating around the axis of the target plate bottom from where the target plate is attached when hit by the shooter's projectile; and c. a mechanical method that allows for said target plate to be pulled mechanically downward, back to its starting position, whether in the raised position and not hit, or in the fallen hit position, such that it is mechanically reset back to the starting position while being out of the view of the shooter during the movement of this operation.

5. The system, as described in claim 1, comprising an embedded computer controller that:

a. determines the target plate position, both in the:

i. up and down linear position; and ii. the hit position where the target plate is not in-line with the linear movement as well as the non-hit position where the target plate is in-line with the linear movement;

b. control the linear motor movement such that it can cause the mechanism to:
   i. move upward;
   ii. move downward; and
   iii. control the speed of the motor in both the up and down direction to allow for consistent speeds between different targets and system, wherein the speed control uses feedback from position sensors to determine speed of the target plate through a rolling average to maintain a consistent speed, equal among targets, c. operate on a battery.

* * * * *